US005166707A

United States Patent [19]

Watanabe et al.

[11] Patent Number: 5,166,707

[45] Date of Patent: Nov. 24, 1992

[54] INK JET RECORDING APPARATUS HAVING EASY-ACCESS RECORDING MEDIUM CONVEYANCE ROUTE

[75] Inventors: Fumihiko Watanabe; Atsushi Saito, both of Yokohama; Akio Okubo, Tokyo; Yasuyuki Shinada, Yokohama, all of Japan

[73] Assignee: Canon Kabushiki Kaisha, Tokyo, Japan

[21] Appl. No.: 655,317

[22] Filed: Feb. 13, 1991

[30] Foreign Application Priority Data

Feb. 13, 1990 [JP] Japan ..... 2-31710
Feb. 13, 1990 [JP] Japan ..... 2-31719
Feb. 13, 1991 [JP] Japan ..... 3-19939

[51] Int. Cl.[5] ..... B41J 2/165

[52] U.S. Cl. ..... 346/140 R; 346/145; 358/296

[58] Field of Search ..... 346/140 R, 75; 400/126, 400/701, 702, 702.1; 101/416.1, 425; 358/296

[56] References Cited

U.S. PATENT DOCUMENTS 4,313,124 1/1982 Hara ..... 346/140 R
4,345,262 8/1982 Shirato et al. ..... 346/140 R
4,371,881 2/1983 Bork et al. ..... 346/140 R
4,459,600 7/1984 Sato et al. ..... 346/140 R
4,463,359 7/1984 Ayata et al. ..... 346/1.1
4,558,333 12/1985 Sugitani et al. ..... 346/140 R
4,559,543 12/1985 Toganoh et al. ..... 346/140 R
4,723,129 2/1988 Endo et al. ..... 346/1.1
4,731,639 3/1988 Gutmann et al. ..... 355/64
4,740,796 4/1988 Endo et al. ..... 346/1.1
4,999,643 3/1991 Terasawa ..... 346/1.1
5,040,000 8/1991 Yokoi ..... 346/140 R
5,055,861 10/1991 Murayama ..... 346/140 R

FOREIGN PATENT DOCUMENTS 54-056847 5/1979 Japan .
0074890 6/1980 Japan ..... 400/126
58-063462 4/1983 Japan .
0045161 3/1984 Japan ..... 346/75
59-123670 7/1984 Japan .
59-138461 8/1984 Japan .
60-071260 4/1985 Japan .
2087800 6/1982 United Kingdom .

*Primary Examiner*—Joseph W. Hartary
*Attorney, Agent, or Firm*—Fitzpatrick, Cella, Harper & Scinto

[57] ABSTRACT

An ink jet recording apparatus which records on a recording medium by discharging ink on a recording medium. The ink jet recording apparatus comprises an ink jet recording head which discharges ink to record on a recording medium, a conveyance route which leads the recording medium in the exhaust direction passing above the recording head, and a cap which covers the discharge ports of the recording head provided below the ink jet recording head.

10 Claims, 25 Drawing Sheets

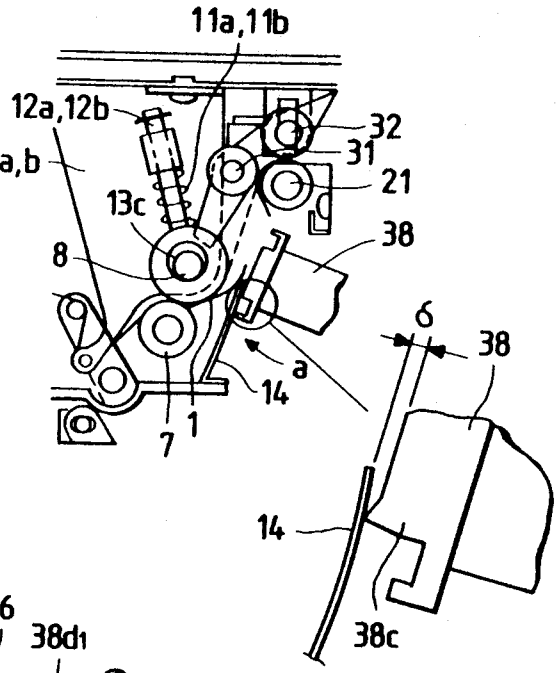
FIG. 7A
FIG. 7B
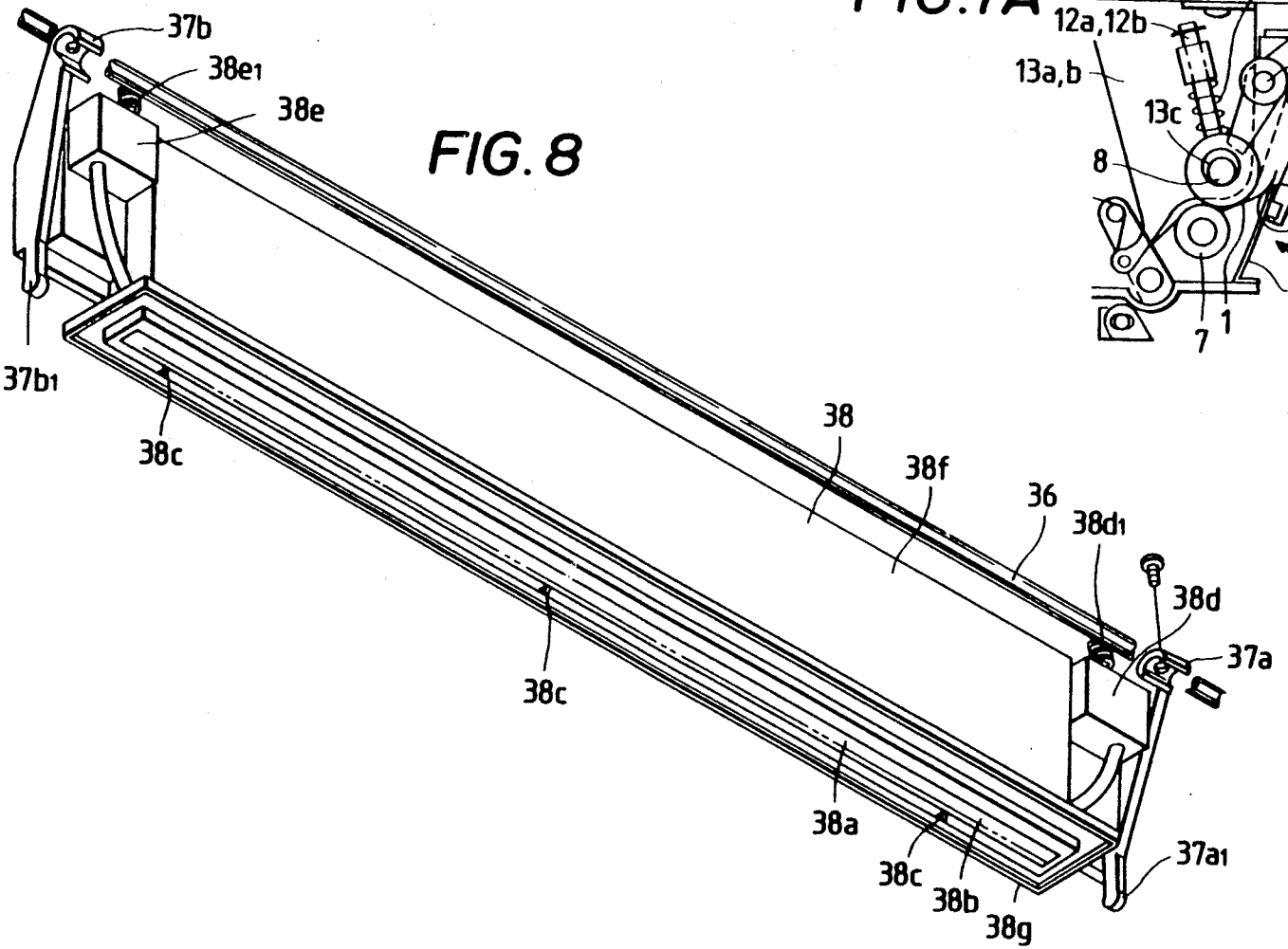
FIG. 8

38
37a
41a
42
60
56a
46a
61a
47a
48a
59a1
41
b
c
63
70a
59a
X
38a
41c
41b
44
45
43
a
37a,37b
38c
37a1,37b1
48a1,48b1
59a,59b
59a1,59b1
d

INK JET RECORDING APPARATUS HAVING EASY-ACCESS RECORDING MEDIUM CONVEYANCE ROUTE

BACKGROUND OF THE INVENTION

1. Field of the Invention

This invention relates to an ink jet recording apparatus which records on a recording medium by discharging ink on the recording medium.

2. Related Background Art

A recording apparatus such as a printer, copying machine and facsimile is so constructed that an image consisting of a dot pattern is recorded on a recording sheet such as paper and thin plastic sheet by driving an energy generating unit for a recording head in accordance with image information to be transmitted.

Among said recording apparatus, the ink jet recording apparatus has very low noise during recording and a high-density multidischarge port is easily provided, and therefore it is capable of recording at high speed. Since color reproduction of a color image is also easy, it has been drawing attention recently.

Among the rest, a method to discharge and project an ink droplet by utilizing heat energy is capable of providing the highest density among all recording methods because a flow path can be formed by using the thin film technique, and accordingly, this can be said to be suitable for high-speed recording.

In a facsimile apparatus, for example, which is generally used, it was so constructed that a roll-shaped wound recording sheet is continuously conveyed under an area, where the thermal head has been placed, by the specified conveyance means, and recording is started by receiving a signal.

In case said ink jet recording head has been adopted as a recording head which records on a recording sheet, when an ink droplet, for example, adheres to the discharge port surface of the ink jet recording head for some reason, it is likely to drip and adhere to the recording sheet which is being conveyed below the recording head.

Since the conveyance route for the recording sheet is complicated and long, a recovery operation such as treating a jammed sheet, setting a new recording sheet and a replacement operation can also be troublesome.

In the ink jet recording apparatus, on the other hand, there is a supply system (such as ink tank, pump and pipe), which feeds ink to the recording head, and a recovery system (such as wiping means and cap), which normalizes the state of discharge of the recording head, in addition to the recording head, and the parts for these units are naturally located near the recording sheet pass.

When the recording sheet pass becomes complicated for this reason and thereby sheet conveyance trouble occurs, trouble may occur with the surrounding recovery system. Also there is a technical problem that ink leakage from parts of which the ink supply system is composed is likely to dirty the recording sheet as it passes.

SUMMARY OF THE INVENTION

It is an object of the present invention to provide an ink jet recording apparatus which can simplify a conveyance route for the recording medium and prevent conveyance trouble for the recording medium.

It is another object of the present invention to provide an ink jet recording apparatus which does not make the recording medium and conveyance route for the recording medium dirty with ink, etc.

It is another object of the present invention to provide an ink jet recording apparatus capable of easily treating a jammed recording medium.

BRIEF DESCRIPTION OF THE DRAWINGS

FIG. 6 and FIGS. 7A and 7B are side views showing the vicinity of a recording head.

FIG. 8 is a perspective view showing the recording head.

DETAILED DESCRIPTION OF PREFERRED EMBODIMENTS

Hereinafter the present invention will specifically be described in accordance with embodiments of the invention.

Figure 1A:
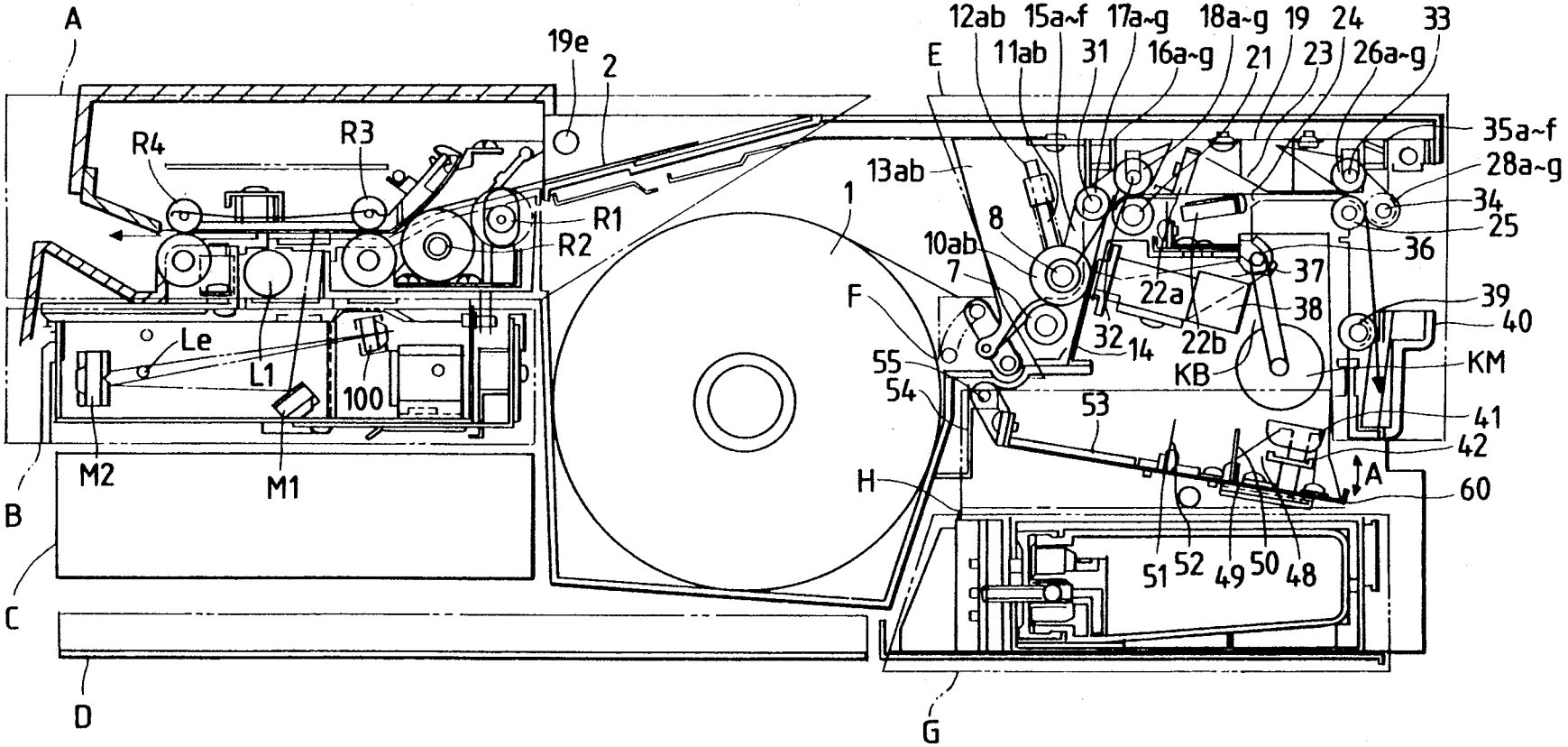
FIG. 1A is a cross-sectional side view showing a facsimile apparatus to which an embodiment of the present invention is applied.
Figure 1B:
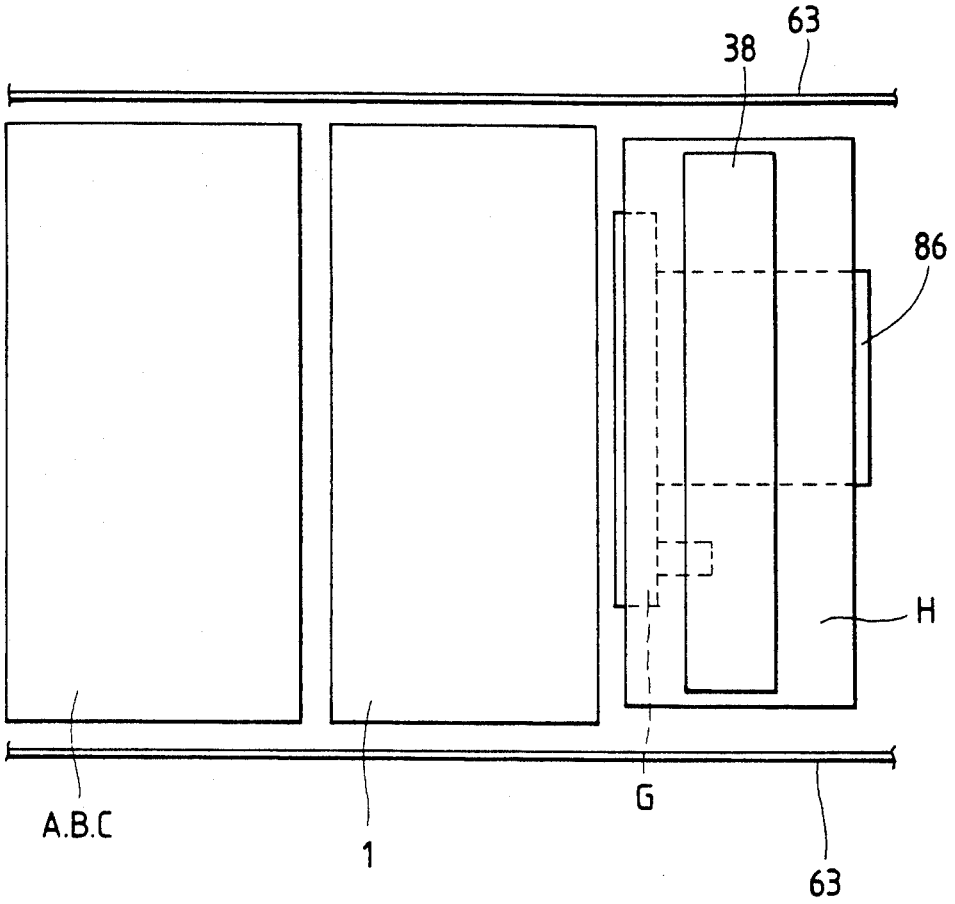
FIG. 1B is a top plan view of the apparatus shown in FIG. 1A.
Figure 2:
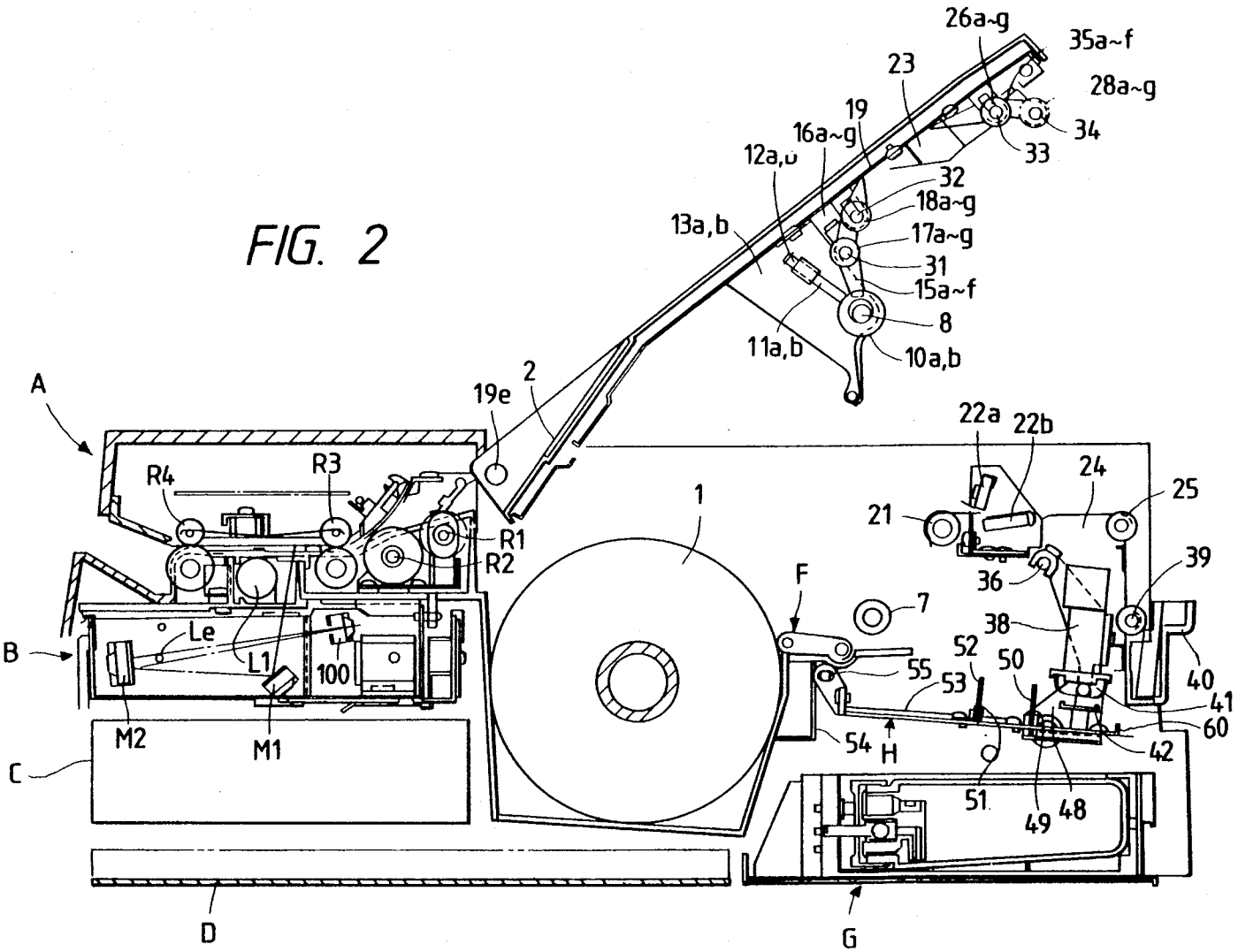
FIG. 2 is a cross-sectional side view showing the state where the apparatus shown in FIG. 1A is opened.

FIG. 1A is a central sectional view showing an embodiment of a facsimile apparatus characteristically representing the present invention. FIG. 1B is a top plan view thereof, and FIG. 2 is a cross-sectional view showing the apparatus in an open state. The facsimile apparatus of the present embodiment roughly comprises original conveying system A, optical system B, power source unit C, electric circuit board D, recording sheet conveying system E, decurling system F, ink supply system G, and recovery system H. Here, aforesaid original conveying system A and optical system B constitute an original reading unit for reading original images. Then, as the basic action of a facsimile apparatus, when an original 2 is set for transmitting or copying, original coveying system A conveys the aforesaid original 2 sequentially by a roller train (rollers R1, R2, R3, and R4) driven by driving means (not shown) in order to read the original image of original 2. Thus, the original line information is transferred by condenser lens Le to line CCD 100 through the reflective optical path of optical system B (lamp L1, mirrors M1 and M2) from a given position for reading the original line (main scanning line) in the course of its conveyance, and is converted into electrical signals for the reading of the original information. At the time of receiving or copying, recording sheet conveying system E sequentially conveys the recording sheet, which is wound in roll, by a roller train driven by driving means (not shown) to a passage shown in FIG. 1, and recording is performed in the course thereof by discharging ink from discharging ports of recording head 38 onto a given recording line of the recording sheet. Ink is discharged from the discharging ports of recording head 38 with the utilization of heat energy. This heat energy is generated by an electric heat converter provided in recording head 38. In this respect, power source unit C received a normal AC to convert it into all the necessary voltage currents and supplies them respectively to each of the units of the apparatus. The electric circuits with electric circuit board D at its center controls the functional operation of each unit of this apparatus mainly with a microcomputer system provided. It also performs the connection and disconnection with transmission lines as well as the input and output of image information signals. Ink supply system G supplies ink to the recording head, and recovery system H performs the cleaning and capping of the face of discharging ports, which are needed for the maintenance of the head.

In this respect, as shown in FIG. 1B, rolled recording sheet 1 is positioned almost in the center of the apparatus, and on the left-hand side thereof, original conveying system A, optical system B, and power source unit C are arranged in the vertical direction, and on the right-hand side thereof, recording head 38, record head recovery system H, and ink supply system G with ink tank 86 are arranged sequentially in that order from above. Since recording head 38, recording head recovery system H, and ink supply system G are thus arranged sequentially from above, the ratio of pressure variation of ink tank 86 against the orifice face of recording head 38 is reduced (i.e., the pressure against each of the discharging ports is equalized) even if the apparatus is inclined according to the present embodiment, and excellent recording can be performed. This is due to an arrangement such that despite the miniaturization of the apparatus, the space between the orifice face of the recording head and the ink tank 86 is made greater.

Hereinafter, each structure of the recording head and operation will be described following its operational sequence. Rolled recording sheet 1 is installed, and is pinched by driving feed roller 7 and free roller (platen roller) 8 which is in contact with said driving roller 7 through decurling system F for straightening out the curl formed on the recording sheet 1. Feed roller 7 is driven by driving means (not shown) with, for example, a stepping motor as its power source.

Figure 3:
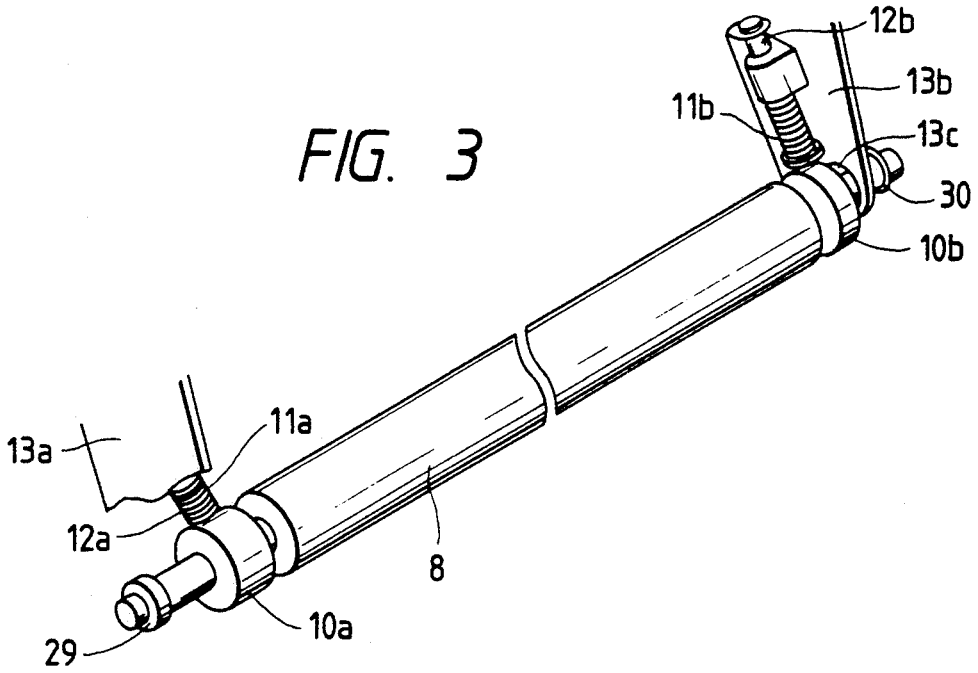
FIG. 3 is a perspective view showing the vicinity of a platen roller.

Here, FIG. 3 is a perspective view showing parts arranged in the longitudinal direction in the vicinity of free roller 8 (platen roller). A first platen side plate 13*a* and a second platen side plate 13*b* fixed to or integrally formed with recording frame 19 support free roller 8 with a play in such a manner that the shaft of the free roller is penetrated through the opening 13*c* provided each of the side plates, having a larger diameter than that of the shaft. The E rings 29 and 30 are fixed respectively at both ends of the shaft of free roller 8 as locks and further, on both shaft parts of free roller 8, bearings 10*a* and 10*b*, the inner and outer diameters of which are accurately regulated to provide an equal coaxiality, are fittedly mounted on the shaft of free roller 8 to enable it to be freely rotated. In the meantime, the aforesaid first platen side plate 13*a* and second platen side plate 13*b* are slidably arranged each with the respective platen pressure shaft 12*a* and 12*b* mounted on the inner side thereof as shown in FIG. 3. Then, by the functions of springs 11*a* and 11*b*, the aforesaid platen pressure shafts 12*a* and 12*b* are in contact with bearings 10*a* and 10*b* of the aforesaid free roller 8 respectively to exert pressure against each of them.

Now, reverting to FIG. 1A, recording head 38 is at the recording position. At this juncture, free roller 8 is positioned by being in contact in two directions with feed roller 7 by the pressure exerted by free roller 8 as well as with recording head 38 by contacting the aforesaid bearings 10*a* and 10*b*. In other words, the direction in which the pressure of platen pressure shafts 12*a* and 12*b* of free roller 8 is exerted is set towards the direction that free roller 8 is in contact with free roller 7 and that bearings 10*a* and 10*b* are in contact with recording head 38. At the same time, recording guide 14 made of thin plastic plate guides the aforesaid recording head 38, so that the recording head is rotated to the recording position with head shaft 36 as its rotational center.

Thus, the sheet path is matched with the recording line position, and recording head 38 discharges ink from its discharging ports onto the aforesaid recording line position for recording at the time of recording.

Next, recording sheet 1 is pinched by first exhaust sheet roller 21 and the roller train 17*a*–17*g* and roller train 18*a*–18*g* which are in contact with the aforesaid first exhaust sheet roller 21 to be conveyed while being guided by first curvature guide 15 and first exhaust sheet guide 20.

In this respect, the aforesaid first exhaust sheet roller 21 is driven by the driving system of the same power source as feed roller 7, and is so arranged that the peripheral speed of the aforesaid first exhaust sheet roller 21 is slightly faster than that of the aforesaid feed roller 7.

Figure 4:
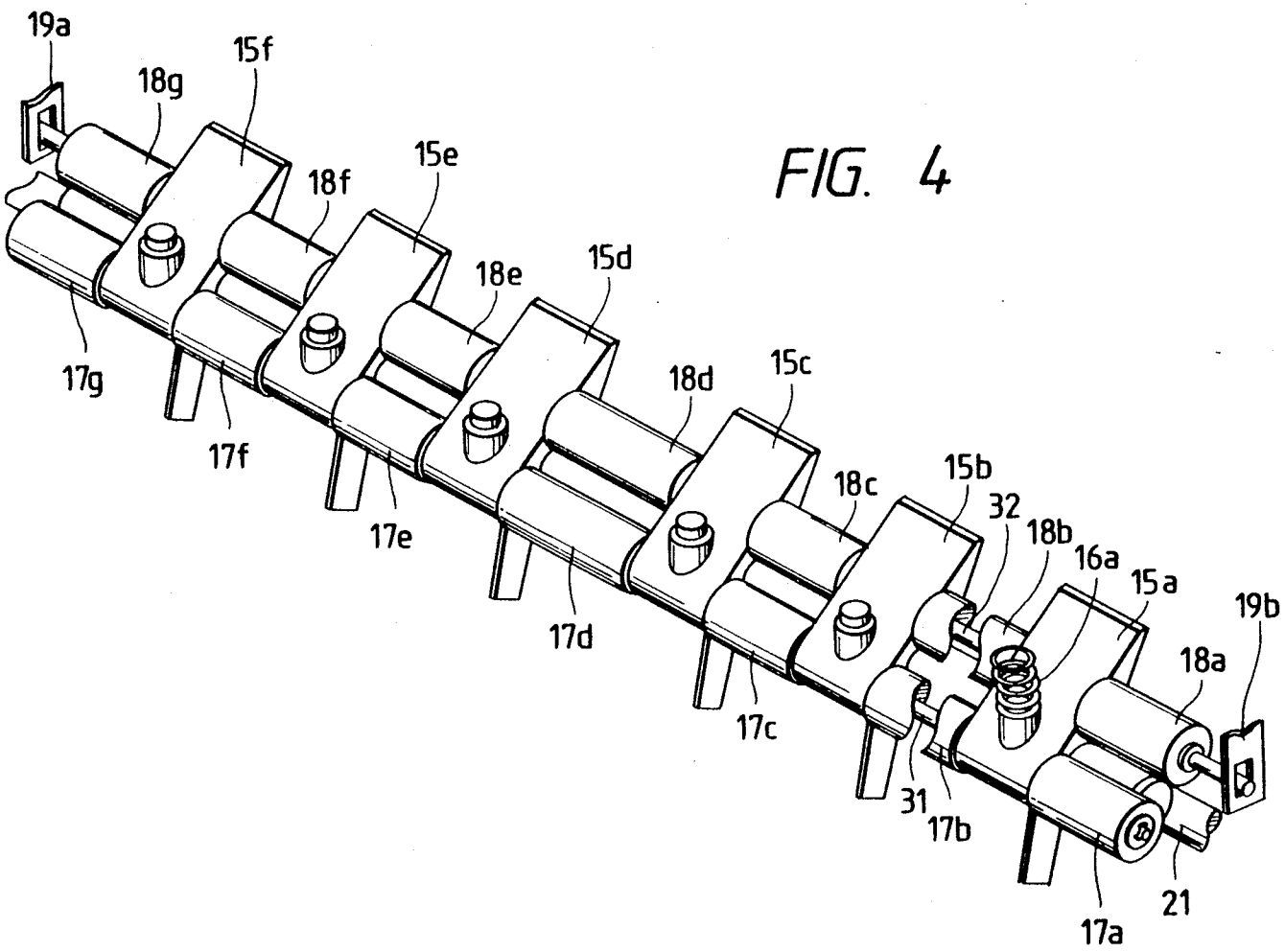
FIG. 4 is a perspective view showing an exhaust sheet roller.

Here, FIG. 4 is a perspective view showing the parts arranged in the longitudinal direction in the vicinity of first exhaust sheet roller 21. Rollers 17*a*–17*g* and roller 18*a*–18*g* are arranged alternatively with first curvature guides 15*a*–15*f*. Each of them is rotatably supported by shaft 31 and shaft 32 and both ends of the shafts are locked by E rings, etc. Also, at both ends, shaft 32 is regulated by receiving side 9*a* of the first exhaust sheet rollers, which is fixed to or integrally formed with recording frame 19 and receiving side 19*b* of the second exhaust sheet rollers, and also in the horizontal direction, the shaft is regulated at both ends thereof by the vertically elongated through holes having the diameter fitted to that of shaft 32, through which the shaft is penetrated. The both ends of the shaft are also locked by E rings (not shown), etc. In this respect, compression is generated by springs 16*a*–16*f* represented only by a reference numeral 16*a* in FIG. 4 for recording chassis 19 and first curvature guides 15*a*–15*f* (refer to FIG. 1) to cause rollers 17*a*–17*g* and roller 18*a*–18*g* to be in contact with exhaust sheet roller 21 by pressure. As a result, when recording sheet 1 is pinched thereby, the power to convey the recording sheet is generated. Then, recording sheet 1 is guided to upper exhaust sheet guide 23 and trailing exhaust sheet guide 24 through the space between both edges 22*a* and 22*b* which cut the recording sheet into each of the receiving one pages and is further guided and conveyed by second exhaust sheet roller 25 and the rollers 27*a*–27*g* and rollers 28*a*–28*g* which are in contact therewith. In this respect, second exhaust sheet roller 25 is also driven by the driving system in such a manner that the peripheral speed thereof is set at a speed slightly faster than that of the aforesaid first roller 21. Here, too, as in the vicinity of the aforesaid first exhaust sheet roller 21, rollers 27*a*–27*g* and rollers 28*a*–28*g* are arranged alternately with second curvature guides 26*a*–26*f* and are rotatably supported respectively by shaft 33 and shaft 34. Then, both ends of shaft 34 are locked with E rings, etc. Shaft 33 is regulated at both ends thereof by exhaust sheet roller receiving sides 19*c* and 19*d* fixed to or integrally formed with recording frame 19, having vertically elongated holes fitted respectively to the diameter of shaft 33, through which both ends of the shaft are penetrated horizontally. The ends thereof are also locked by E rings, etc. With springs 35*a*–35*f*, compression is generated between recording frame 19 and second curvature guides 26*a*–26*f* (refer to FIG. 1) to cause rollers 27*a*–27*g* and rollers 28*a*–28*g* to be in contact with second exhaust sheet roller 25 by pressure, so that when the recording sheet 1 is pinched thereby, the conveying power is generated. In this way, the recording sheet is exhausted after recording has been completed, and is further conveyed by exhaust sheet roller 39 in the form of being cut into the unit of one page while the leading and thereof is being held smoothly by stacker 40. As a result, an operator can take out the recording sheet thus stacked on stacker 40.

Figure 5:
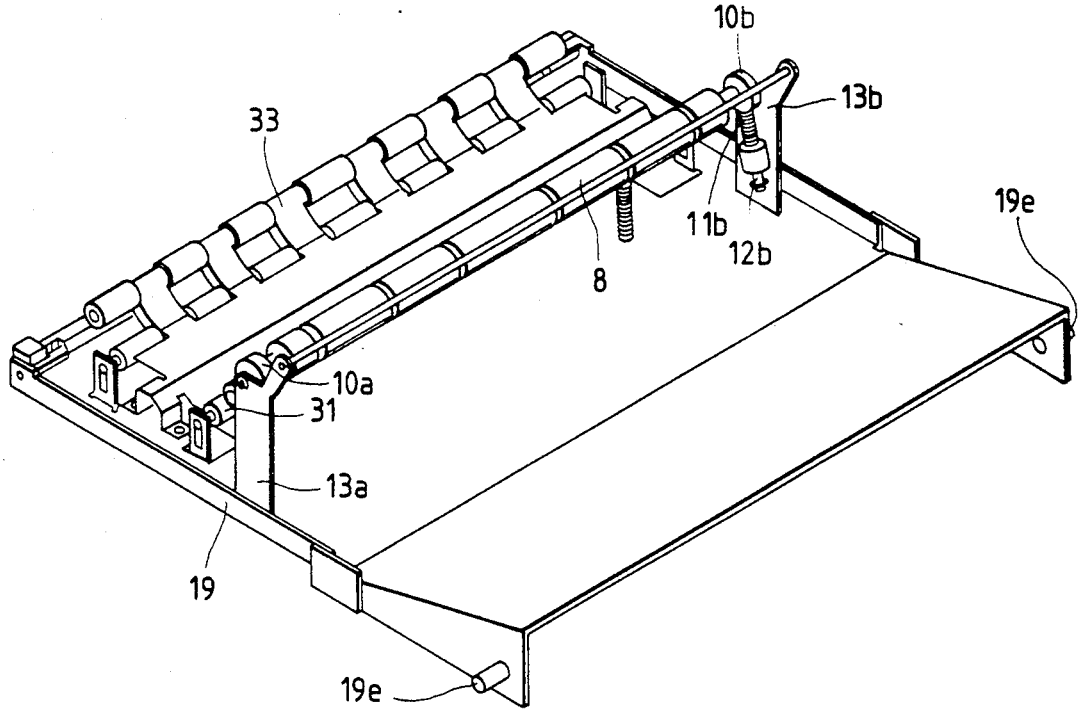
FIG. 5 is a perspective view showing a recording frame.

As the above describes, the recording sheet conveying system is structured to carry out its operation. Here, FIG. 1 shows the state of the system at the time of recording, and at the time of replacing the recording sheets or troubleshooting in conveying recording sheet, recording frame 19 can be opened or closed with hinge 19*e* of recording frame 19 as its pivoting point. In other words, as shown in FIG. 2, the recording frame can be opened just along the recording sheet conveying path as its boundary, and the arrangement is designed to place each of the components belonging to recording frame 19 above this boundary and each of those belonging to main body frame 63 below the boundary. This recording frame 19 and the assembly of its components thereon are shown in FIG. 5.

As set forth above, in the present embodiment, recording head 38, recording head recovery system H, and ink supply system G are sequentially arranged from above in that order. Thus, recording sheet 1 is guided in the horizontal direction above recording head 38 after the recording has been completed by recording head 38, and is further conveyed downwards thereafter to exhaust sheet stacker 40 for stacking. Here, the path through which the aforesaid recording sheet is being guided in the aforesaid horizontal direction forms the aforesaid boundary along which the main body is opened. Therefore, according to the present embodiment, it is easy to remove a clogged sheet if any clogging should occur, and further, it is possible to perform capping without damaging the head face when a sheet clogging takes place. In addition, should ink leakage occur while capping, the recording sheet is not stained.

Next, the positioning of free roller 8 (platen roller) will be described.

Figure 6:
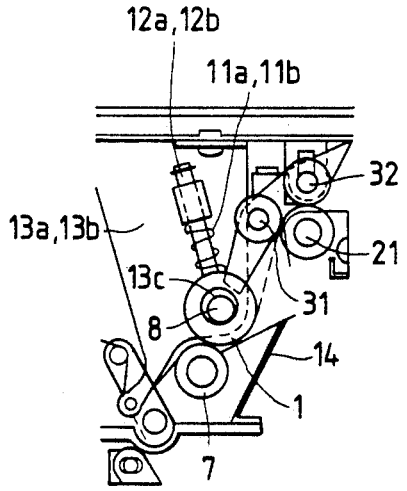

First, FIG. 6 illustrates the state of parts in the vicinity of free roller 8 when the main body of the apparatus is in standby. Recording guide 14 is not allowed to be in contact with free roller 8 unless there is an external force to be exerted thereon. Accordingly, the contacting angle of recording sheet 1 to the periphery of free roller 8 is less in the standby state than in the printing state. At this juncture, the position of free roller 8 is established by the fact that the periphery of free roller 8 is pressed by platen pressing shafts 12*a* and 12*b* to be in contact with feed roller 7, and that the shaft of free roller 8 is in contact with through hole 13*c*, which is larger than the periphery of the aforesaid shaft by 0.1 mm–several mm, provided on each of platen side plates 13*a* and 13*b*. Here, the aforesaid feed roller 7 and free roller 8 are made of plastic material such as rubber, etc. rolled around a rigid shaft made of iron, etc.

Next, FIG. 7 illustrates recording head 38 being rotated clockwide with head shaft as its rotating center in order to shift itself from the standby state to the recording state. When head 38 is first rotated as described earlier by the driving power generated by motor KM, a plurality of projections provided on the recording face of head 38 are in contact with the top of recording guide 14 to cause recording guide 14 to begin resiliently deforming it. Here, projection 38*c* provided on the recording face of head 38 is made to be increasingly higher towards the corner. Thus, recording guide 14 is deformed apart from recording head 38 by the height (δ in FIG. 7) of the aforesaid projection.

The reason why the aforesaid projection 38*c* is arranged to be increasingly higher towards the corner is to make it easier to remove ink when the recording face of the head is wiped as described later.

Recording head 38 is further rotated clockwise, and when recording head 38 is moved to be in the recording state as shown in FIG. 1, both ends of the recording face of recording head 38 are in contact with bearings 10*a* and 10*b*. Hence, the space between the recording face of recording head 38 and platen roller (free roller) 8 is established. In the present embodiment, the periphery of bearings 10*a* and 10*b* is made larger than that of free roller 8, and the volume thereof is set to be less than the height δ of the aforesaid projection of recording head 38 by a 1/several mm thereof. Thus, guide 14 is reliably in contact with the periphery of platen roller 8 to convey the recording sheet. Here, at the time of recording, the aforesaid feed roller 7 is rotated clockwise, and platen roller 8 is rotated counterclockwise by the external force generated by the feed roller, at the same time, being moved in the direction towards the recording head 38. Hence, with the structure described earlier, the aforesaid platen roller 8 is brought into contact with guide 14 through the recording sheet. Therefore, the aforesaid springs 11*a* and 11*b* are not necessarily needed, and platen roller 8 can also be in contact with the guide only by its own weight.

Next, using the perspective view shown in FIG. 8, the structure of the peripheral parts of recording head 38 will be described. Recording head 38 mainly comprises head main body 38*f* including a heat generating section, electrical part section, and glass chamber section for containing liquid ink, front filter 38*d* and rear filter 38*e* arranged respectively at the outside of the head main body, and head front plate 38*c*. Also, front head ink connection 38*d*$_1$ and rear head ink connection 38*e*$_1$ are respectively provided for front filter 38*d* and rear filter 38*e*. These are tightly closed and connected respectively by front ink supply 71 and ink supply tube threading with sealing members (not shown) provided therebetween. A reference numeral 38*a* designates an imaginary two-dot chain line in FIG. 8 to represent the straight line formed by connecting the center lines of the nozzles aligned. A plurality of nozzles are aligned in order to form an image on a recording material across the entire width thereof in the direction of main scanning. Hereinafter, these are referred to as nozzles 38*a*. In practice, however, holes of several tens of microns in diameter are provided, and the aforesaid holes are connected to ink supply tubes 71 and 72. Here, the opposite ends of ink supply tubes 71 and 72 are respectively connected to front supply tube joint 84 and rear supply tube joint 85. Now, in FIG. 8, a reference numeral 38*b* designates the face where nozzle 38 is open, which is called the orifice face. In this respect, front head plate 38*g* is formed by metal or molding material, and the space between orifice face 38*b* and front head plate 38*g* is filled with silicon rubber, etc. to close them completely. Filters 38*d* and 38*e* are arranged to prevent dust in the ink from flowing into the nozzle section. Reference numerals 37*a* and 38*b* designate front and rear head arms made of engineering plastic, sintered metal, diecast metal, or the like, which has rigidity and resistivity against thermal deformation at high temperatures, and each of them is fixedly mounted on BJ head 38 by means of screws etc.

Front head arm 37*a* and rear head arm 37*b* are fixedly mounted on head shaft 36 by means of screw, etc., and with the structure as described earlier, head shaft 36 and BJ head 38 are fixedly arranged. Head shaft 36 is rotatably supported by main body frame 56 through bearings (not shown). Head shaft 36 is connected to a driving system comprising gears, belts KB, etc., and is further connected to stepping motor KM.

Next, using the perspective view shown in FIG. 9, the structure of the peripheral parts of cap 41 will be described. Although the shape of cap 41 will be described later in detail, cap 41 is formed by plastic material such as silicon rubber, etc. which has a high resistivity against mechanical creep as well as a high ratio of permeability for water vapor, etc. A reference numeral 42 designates a cap keel made of rigid material such as aluminum, stainless steel, etc., and as shown in a cross-sectional view in FIG. 10, short shafts 46*a*, 46*b*, 46*c*, 46*d*, and 46*e* are fixedly mounted on cap keel 42 by means of screws. Short shafts 46*a*–46*e* should desirably be made of a corrosion-inhibiting and rigid material such as stainless steel, etc. In the present embodiment, although short shafts 46*a*–46*e* are fixed by screws, these can also be coupled by means of press fitting, bonding, or the like. Also, cap keel 42 and shafts 46*a*–46*e* can be formed integrally by means of molding, etc.

Here, the formation of the cap 41 is first made by coupling cap keel 42 and short shafts 46*a*–46*e* as described above. Then, the coupled cap keel 42 and short shafts 46*a*–46*e* are buried into an open forming die, and by putting silicon rubber, which is also the original material of cap 41, into the die or sandwiching silicon rubber between cap 41 and cap keel 42, these are integrally formed by burning into a single body. Here, the shape of the aforesaid forming die should match the external contour of cap 41 as a matter of course. Now, a reference numeral 60 designates a recovery frame made of a corrosion-inhibiting rigid material such as stainless steel, and the four sides of recovery frame are bent to rise (60*a*–60*d*) in order to enhance the rigidity. The recovery frame 60, short shaft bearings 61*a*, 61*b*, 61*c*, 61*d*, and 61*e* are fixed by screws, etc. (not shown) to receive short shafts 46*a*–46*e*. In this respect, the method for coupling bearings 61*a*–61*e* with frame 60 may also be either welding or bonding. Also, as described later, short shaft 46*a* is fitted into an elongated hole while short shafts 46*b*–46*d* are fitted into the so-called loose holes, and short shaft 46*e* is fitted to perform positioning. In other words, each of the short shafts 46*a*–46*e* has a same outer diameter, and the inner diameter 61*e*$_1$ of short shaft bearing 61*e* and the outer diameter of short shaft 46*e* are made to just fit each other. Short shaft bearings 61*a*–61*e* are made of polyacetal resin having excellent slidability against stainless steel short shaft 46*e*.

Figure 9:
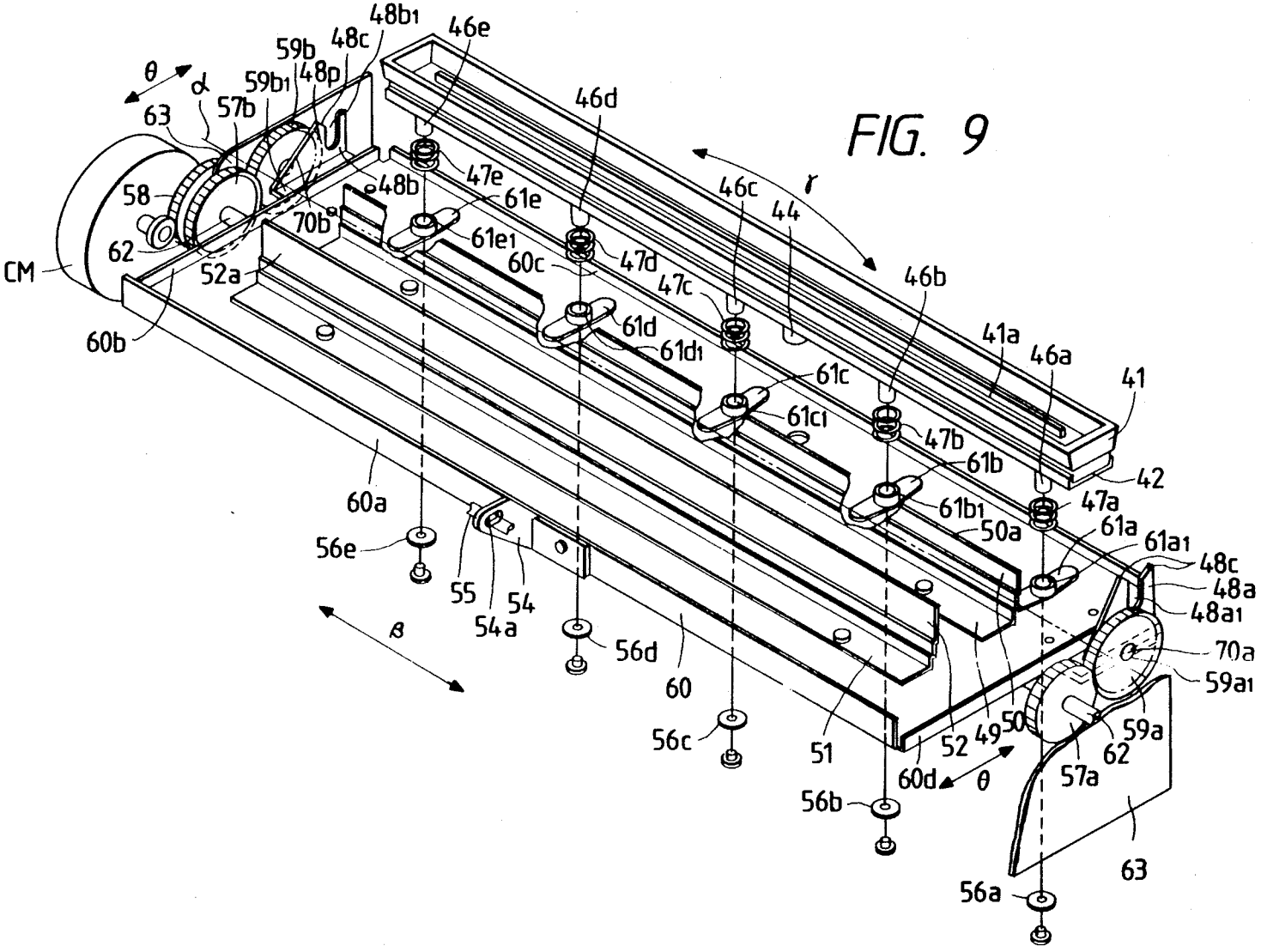
FIG. 9 is a perspective view showing the vicinity of a cap.

As shown in FIG. 9, an elongated hole 61*a*$_1$ is formed for short shaft bearing 61*a* against short shaft bearing 61*e* in the longitudinal direction of cap 41. Then, the dimension of elongated hole 61*a*$_1$ in the transverse direction is formed to fit short shaft 46*a*. The diameters of holes 61*b*$_1$, 61*c*$_1$ and 61*d*$_1$ opened in short shaft bearings 61*b*, 61*c*, and 61*d* are respectively formed larger than the outer diameters of short shafts 46*b*–46*d* within a rage of 0.1 mm–1 mm. Then, at the outside of short shafts 46*a*–46*e*, compression springs 47*a*–47*e* are respectively held by screws from the reverse side of recording frame 60 with short shaft stoppers 56*a*–56*e* sandwiched as shown in FIG. 9.

Compression springs 47*a*–47*e* are pressed between the cap keel and short shaft bearings 61*a*–61*e* because the springs are held by screws. The movement of cap 41 at this juncture will be described later.

Next, first wiper 50 and second wiper 52 are made of plastic material such as rubber, etc. having a good abrasion resistance, and the straight portions of leading ends 50*a* and 52*a* of first and second wipers 50 and 52 are strictly controlled to maintain the straightness as well as to prevent wear and dust, etc. Also, the aforesaid first wiper 50 and second wiper 52 are respectively fixed to first wiper stay 49 and second wiper stay 51 by means of screws, etc. (not shown). First and second wiper stays 49 and 51 are both made of corrosion-inhibiting rigid metal such as stainless steel, etc.

Further, as shown in FIG. 9, first wiper stay 49 and second wiper stay 51 are held on recovery frame 60 by screws, and the projection 41*a* of cap 41, which will be described later, and the wiper leading ends 50*a* and 52*a* are arranged to accurately parallel themselves at this juncture. Also the aforesaid projection 41*a*, wiper leading ends 50*a* and 52*a*, and the mounting face of recovery frame 60 for wiper stays 49 and 51, and the imaginary two-dot chain line $\alpha$ in FIG. 9 connecting the center lines of boss sections 59*a*$_1$ and 59*b*$_1$ of front cam gear 59*a* and rear cam gear 59*b* are arranged to be in parallel accurately as described later. Also, as shown in FIG. 9, the structure is formed to enable the height of the leading end 52*a* of second wiper against recovery frame 60 to be higher than that of the leading end 50*a* of first wiper against recovery frame 60. In order to provide this structure, it is possible to change either the heights of the aforesaid plastic portions made of rubber, etc. of first and second wipers 50 and 52 or the height of rigid portions of first and second wiper stays 49 and 51. Now, a reference numeral 54 designates a recovery frame bearing, and recovery frame shaft 55 shown in FIG. 1C (control cross-sectional view) is allowed to fit the elongated hole 54*a* of recovery frame bearing 54 in the transverse direction. Here, in this respect, recovery shaft 55 is fixed to main body frame 63, but recovery frame shaft 55 may also be supported rotatably by main body frame 63. Recovery frame shaft bearing 54 is made of polyacetal resin having a good slidableness and is fixedly screwed to recovery frame 60. Recovery frame bearing 54 is fixed against recovery frame 60 in the direction indicated by arrow $\beta$ in FIG. 9 at a position which enables the center of the depth of elongated hole 54*a* to be in the central part of recovery frame 60. Also, here, the center of hole 61*c*$_1$ of short shaft bearing 61*c* is positioned in the central part of recovery frame 60 in the direction indicated by arrow $\beta$ as shown in FIG. 9. Further, the center of hole 61*b*$_1$ of short shaft bearing 61*b* and that of hole 61*d*$_1$ of short shaft bearing 61*d* are symmetrically positioned in the direction indicated by arrow $\beta$ with short shaft bearing hole 61*c*$_1$ as the center. Also, the center of elongated hole 61*a*$_1$ of short shaft bearing 61*a* in the direction indicated by arrow 8 and the center of hole 61*e*$_1$ of short shaft bearing 61*e* are likewise positioned symmetrically in the direction indicated by arrow $\beta$ with the hole 61*c*$_1$ as the center. Now, it is desirable to equalize four distances between the centers of holes, i.e. the distance between the centers of holes 61*a*$_1$ and 61*b*$_1$, 61*b*$_1$ and 61*c*$_1$, 61*c*$_1$ and 61*d*$_1$, and 61*d*$_1$ and 61*e*$_1$. Next, a reference numeral 62 designates a recovery frame shaft which is arranged across both of the side plates of main body frame 63. This recovery frame shaft 62 is rotatably supported around a bearing (not shown) provided in main body frame 63. Further, to this recovery frame shaft 62, idler gears 57*a* and 57*b* are fixedly mounted respectively at positions inside the main body frame 63 and outside the front cap guide 48*a* and rear cap guide 48*b* which will be described later. In view of assembling recovery frame 60 in main body frame 63, parallel pins or spring pins (both not shown) and E ring stopper are used as means to fix idler gears 57*a* and 57*b* to recovery frame shaft 62. Further, to recovery frame shaft 62, outer idler gear 58 is fixed with D cut portion formed at an end of recovery frame shaft 62 as its rotation stopper, with main body frame 63 being sandwiched as shown in FIG. 9. Then, to idler gear 57*a* and 57*b*, cam gears 59*a* and 59*b* are arranged to engage with each other. Cam gears 59*a* and 59*b* are rotatably supported on cam gear shafts 70*a* and 70*b* fixed to main body frame 63 respectively at positions outside the cap guides 48*a* and 48*b* and inside the main body frame 63. Here, the modules and number of teeth of gears 57*a*, 57*b*, 59*a*, and 59*b* are the same. Furthermore, gear 58 and gears 57*a*, 57*b*, 59*a*, and 59*b* are of the same number of teeth. Then, gear 58 is connected to stepping motor CM.

Figures 10A, 10B, 10C:
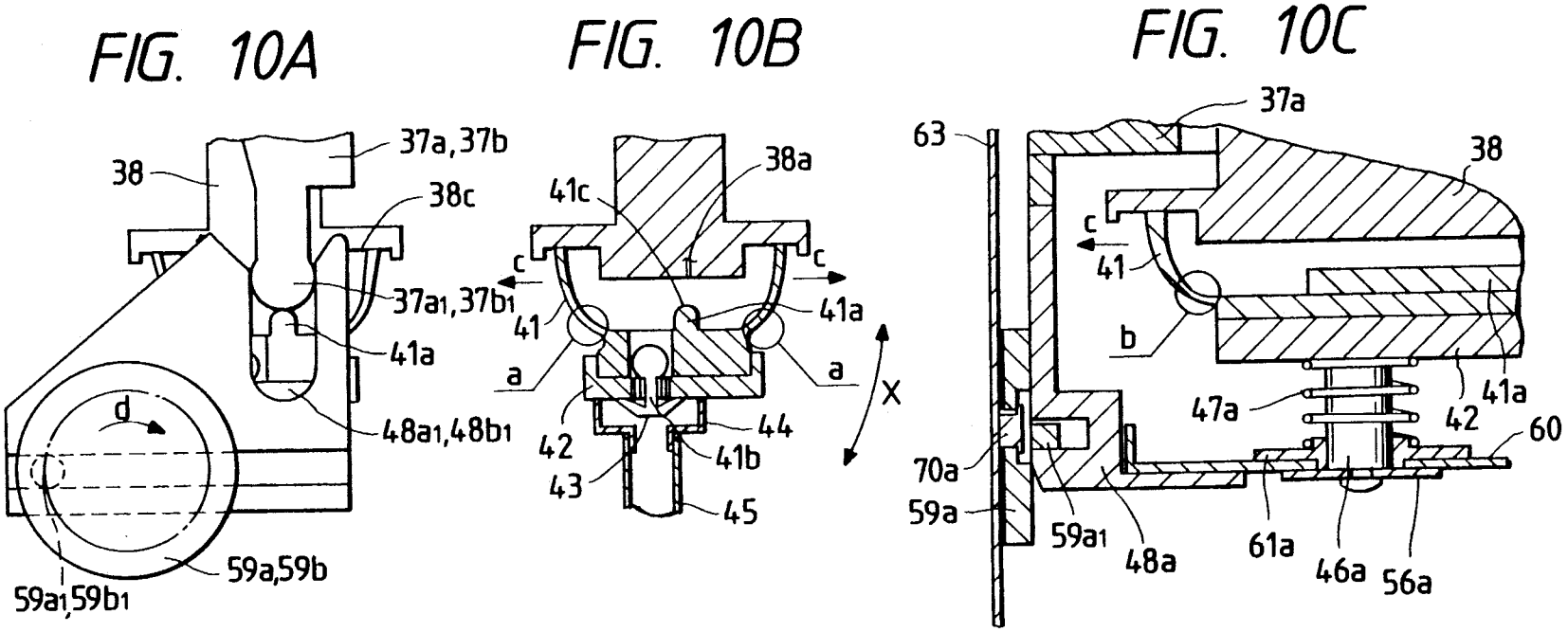
FIGS. 10A–10C are views showing the state immediately after the head and the cap are in contact with each other.

As described above, the number of teeth thus arranged enables the gears engaged with cam gears 59*a* and 59*b* to rotate one round exactly the same as the cam gears completing one round, so that the rotational angles and positions of these gears are detected by a microswitch slit type sensor (not shown), etc. to detect the position of the boss section 59*a*$_1$ of cam gear 59*a* and the boss section 59*b*$_1$ of cam gear 59*b*. Therefore, if only a gear, a timing pulley, or the like, which should complete one round in synchronism with the one rotation of cam gears 59*a* and 59*b*, is arranged in the driving system for detecting the position of such gear, timing pulley, or the like, it is not necessary to make the number of teeth identical to each of the gears 57*a*, 57*b*, 59*a* and 59*b* as in the present embodiment. To recovery frame 60, cap guides 48*a* and 48*b* are fixedly mounted in addition to these gears. Cap guides 48*a* and 48*b* are made of polyacetal resin having good slidability. Then, grooves 48*a*$_1$ and 48*b*$_1$ are formed on cap guides 48*a* and 48*b* to fit the boss sections 59*a*$_1$ and 59*b*$_1$ of cam gears 59*a* and 59*b* in the transverse direction as shown in FIG. 10A. Here boss section 59*a*$_1$ and boss section 59*b* are arranged at positions just opposite to each other.

Since the structure is of such as described above, recovery frame 60 performs rocking motion in the direction indicated by arrow X in FIG. 10B (view) with recovery frame shaft 55 as the center when outer idler gear 58 is rotated.

Now, since the vicinity of recovery frame 60 is constructed with the parts described as above, recovery frame 60 is positioned by the plane formed by two-dot chain line $\alpha$ and recovery frame shaft 55 as shown in FIG. 9. Here, two-dot chain line o and head shaft 36 are arranged to be accurately in parallel. Although recovery frame 60 is positioned by the plane formed by the aforesaid two-dot chain line $\alpha$ and recovery frame shaft 55, it is not fixed by the aforesaid structural members. Recovery frame 60 is structured to be flexible in the direction indicated by arrow $\theta$ and by curbed arrow $\gamma$ in FIG. 9.

Figure 11B:
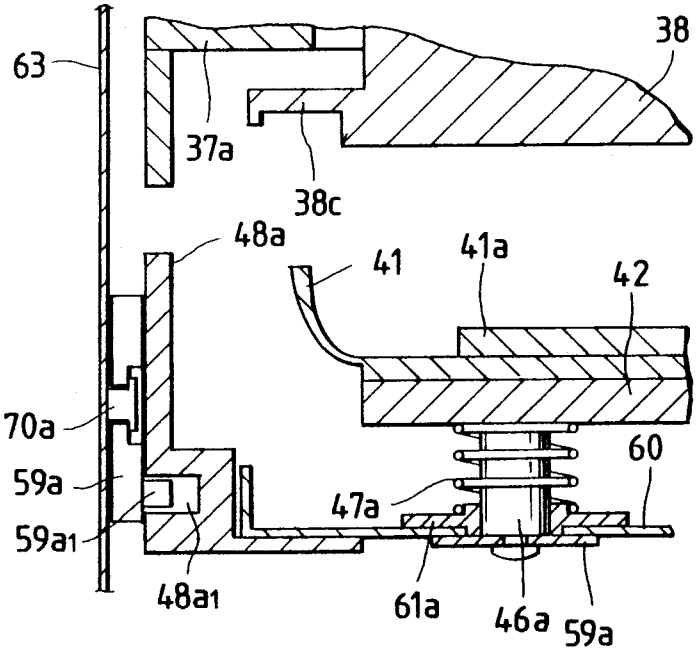
FIGS. 11A and 11B are views showing the state where the head and the cap are apart from each other.
Figure 11A:
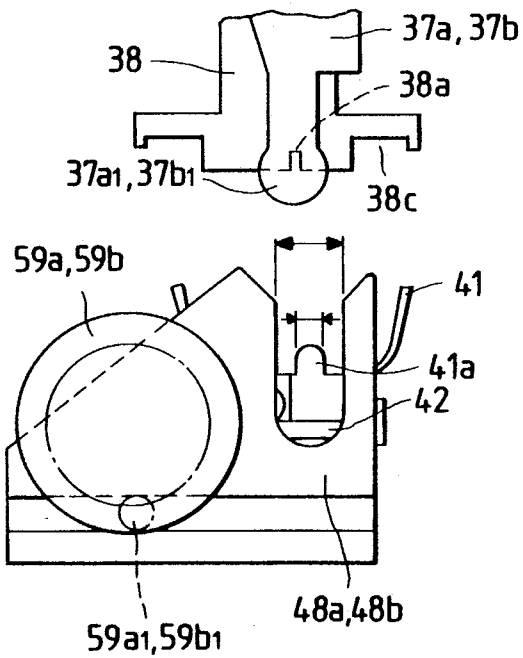

Next, using FIGS. 11A and 11B, the arranging position of first recovery cap guide 48*a* and second cap guide 48*b* is the direction indicated by arrow $\theta$ in FIG. 9 towards recovery frame 60 will be described in detail. On both first and second cap guides 48*a* and 48*b*, U letter type holes 48$a_1$ and 48$b_1$ are formed, and the space of U letter hole is precisely defined. The space of the aforesaid U letter holes 48$a_1$ and 48$b_1$ is indicated by the arrow in FIG. 11A. Then, first and second cap guides 48*c* and 48*b* are arranged on recovery frame 60 to allow the center of the shorter width of projection 41*a* (indicated by arrow in FIG. 11A) of cap 41 to be placed in the center of the aforesaid space of U letter holes 48$a_1$ and 48$b_1$.

Next, on first head arm 37*a* and second head arm 37*b*, circular projections 37$a_1$ and 37$b_1$ are formed respectively on front head arm 37*a* and rear head arm 37*b*. Then, the arranging positions of the aforesaid circular projection 37$a_1$ and 37$b_1$ are defined to allow the ink discharging ports of nozzle section 38*a* to be placed in the central position of the circular projection. Also, the diameter of the aforesaid circular projections 37$a_1$ and 37$b_1$ is formed to fit exactly the spaces of U letter holes on cap guides 48*a* and 48*b*.

Now, since the structure is arranged as described above, when recovery frame 60 is raised by the rotation of cam gears 59*a* and 59*b* at the time of capping, circular projections 37$a_1$ and 37$b_1$ of head arms 37*a* and 37*b* are respectively guided to U letter holes 48$a_1$ and 48$b_1$ of cap guides 48*a* and 48*b*, and nozzle section 38*a* and projection 41*a* of cap 41 are just oppositely placed.

Here, in the present embodiment, recovery frame 60 can be displaced in the direction indicated by arrows $\theta$ and $\gamma$ (in FIG. 9) by the construction as described earier. Therefore, according to the present embodiment, even when there is a slight difference in the positions of the aforesaid U letter holes 48$a_1$ and 48$b_1$ and projection 37$a_1$ and 37$b_1$ at the time of fitting, the recovery frame can fit them reliably while being guided by slant 48*c* and holes 48$a_1$ and 48$b_1$ to displace itself in the horizontal direction if only projections 37$a_1$ and 37$b_1$ are in contact with slant 48*c* of U letter holes 48$a_1$ and 48$b_1$.

Further, the positioning of cap 41 and front head plate 38*c*, which will be described later, is performed naturally in this course of event. Also, even if recovery frame 60 approaches nozzle orifice face 38*b* with some inclination, projection 41*a* and nozzle section 38*a* can approach each other with the face to face positional relationship.

Next, using FIGS. 10 through 15, the shapes and movement of cap 41, cap keel 42, valve 43, valve cover 44, and waste ink tube will be described.

Figure 12C:
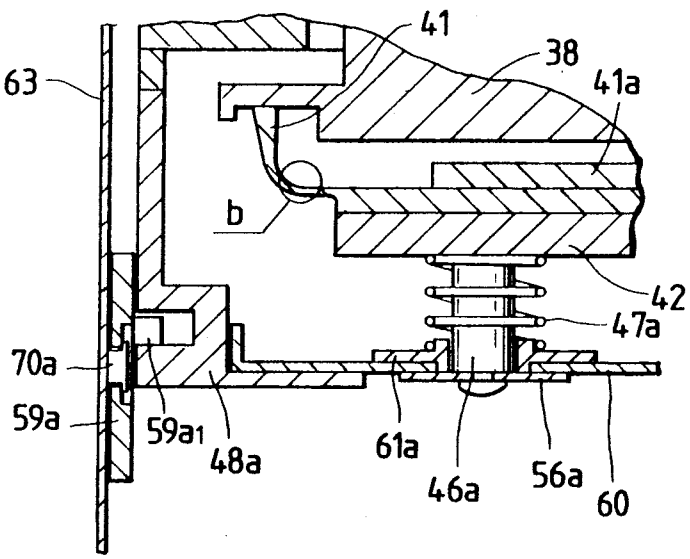
FIGS. 12A–12C are views showing the state where the cap is being moved towards the head.
Figure 13C:
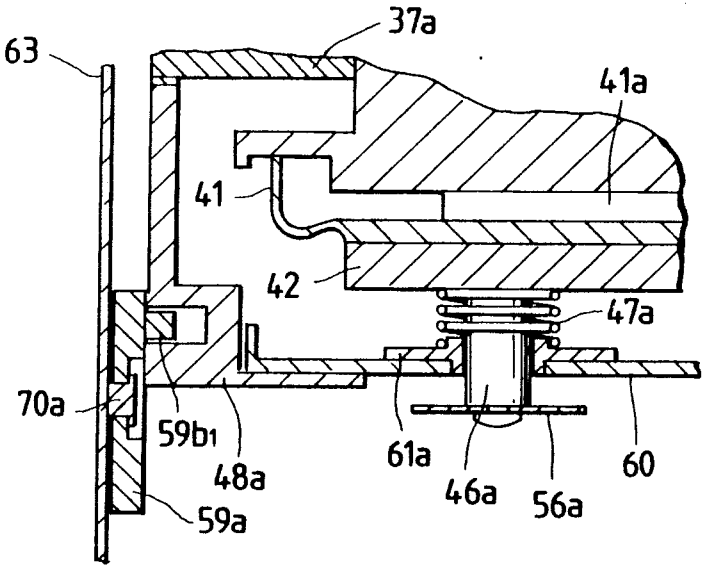
FIGS. 13A–13C are views showing the state where a projection presses a nozzle to be tightly closed while a spring resiliently deformed.
Figure 13B:
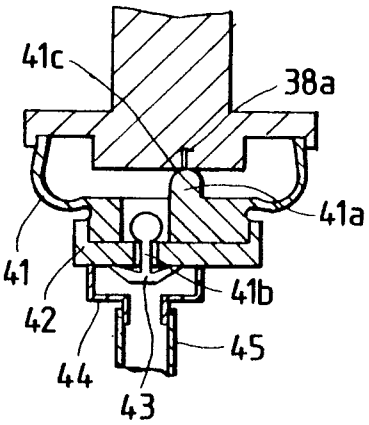
Figure 13A:
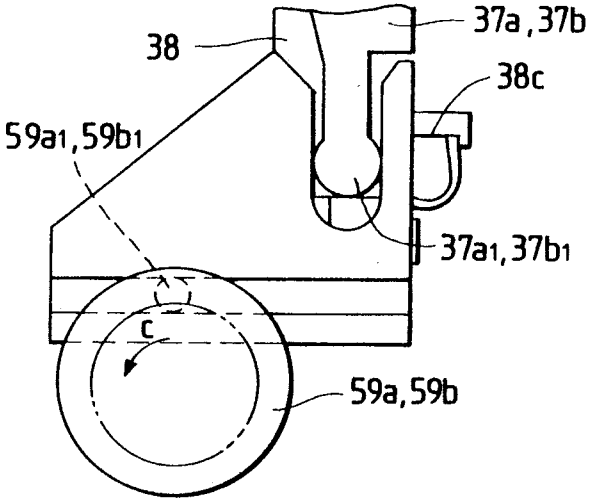
Figure 14C:
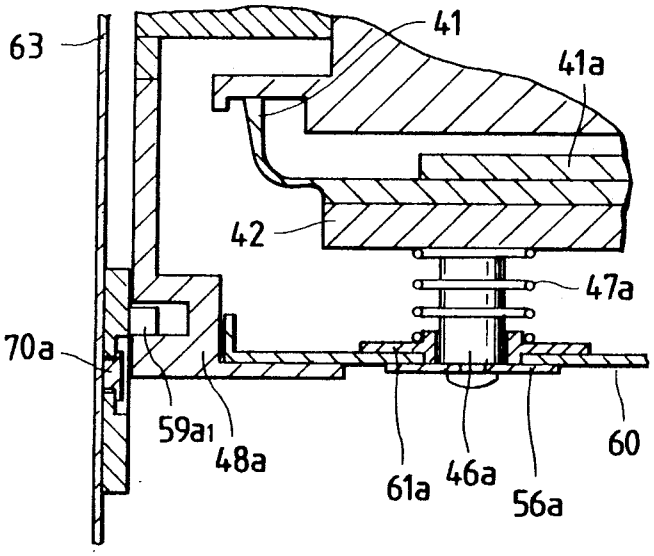
FIGS. 14A–14C are views showing the state where the cap is being parted from the head.
Figure 14B:
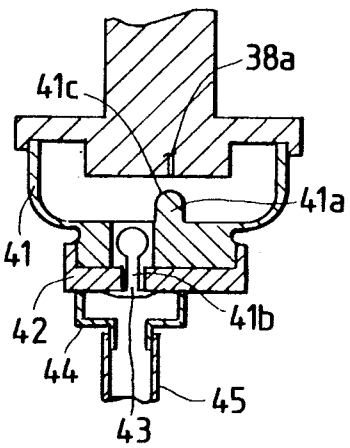
Figure 14A:
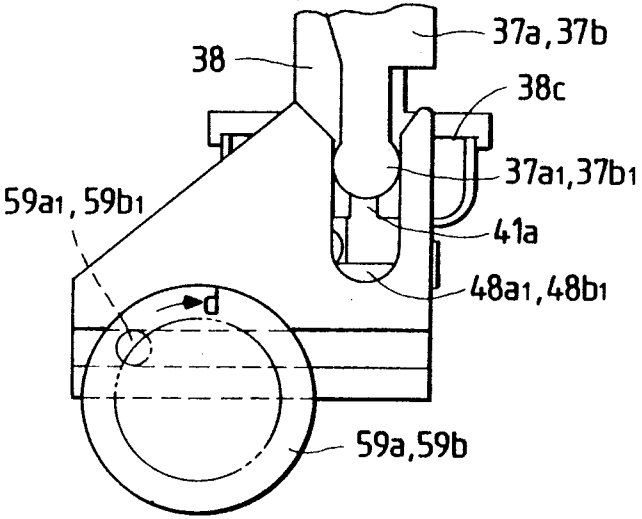

FIG. 10 illustrates the state immediately after head 38 and cap 41 are in contact with each other. FIG. 11 illustrates the state when head 38 and cap 41 are parted. FIG. 12 illustrates the state when cap 41 is moved forwards head 38. FIG. 13 illustrate the state where projection 41*a* closes nozzle 38*a* by pressure, and spring 47 is resiliently deformed FIG 14 illustrates the state where cap 41 is parted from head 38, and FIG. 15 illustrates the standby state. In each of the figures, A is a side view observed from the location of side plate; B is a cross-sectional view in the transverse direction; and C is a cross-sectional view in the longitudinal direction. FIG. 11A, however, is also a side view but FIG. 11B is a cross-sectional view in the longitudinal direction.

At first, FIGS. 10A through 10C illustrate the state representing the moment cap 41 has come into contact with front head plate 38*c*. Cap 41 has not been deformed as yet. In conjunction with FIG. 10B, the cross-sectional shape of cap 41 is described in detail. The side portions of cap 41 are formed with inclinations so as to widen the distance between them as the cap is raised upwards as shown in FIG. 10B. The inclined side portions are connected to the curbed portions indicated by mark a in FIG. 10B, and the thickness of the portions a are made thinner than the other portions as illustrated in FIG. 10B. Although, in the present embodiment, the portions a are formed with a smooth curvature, these portions may also be formed with an abrupt edge. In the case of an abrupt edge in which these should be formed, the thickness of such edge portions could be made thinner. Likewise, in FIG. 10C, the cross-sectional shape of cap 41 in the transverse direction is formed to open itself towards the outside as it is raised upwards as in FIG. 10C.

The cross-sectional shape of cap 41 in the transverse direction is formed in such a manner that the thickness of cap 41 contacting with front head plate 38*c* is made thicker than that of the cross-sectional shape of cap 41 in the longitudinal direction shown in FIG. 10B also contacting the aforesaid front head plate 38*c*. This is due to the fact that although the positioning of cap 41 against head 38 in the transverse direction is accurately performed, the positioning in the longitudinal direction is not, performed accurately. Therefore, such construction as in the present embodiment may not be needed if only the positioning of cap 41 against head 38 is accurately performed in the longitudinal direction. Now, reverting to FIG. 10C, the side portions of cap 41 are connected to curbed portions b which change its shape smoothly as in FIG. 10B, and the thickness of portions b is made thicker. In the present embodiment, the shape of cap 41 in FIGS. 10B and 10C is such that the thickness thereof becomes increasingly thinner smoothly towards as illustrated in these two figures. Now, reverting to FIG. 10B, in the closed space in cap 41, projection 41*a* integrally formed with cap 41 is provided. The arranging position of projection 41*a* is defined so as to allow the top of R shaped portion 41*c* of projection 41*a* to be located at a position against nozzle section 38*a*. The length of projection 41*a* in the longitudinal direction at both ends is made longer than the entire length in which nozzle section 38*a* is arranged. Next, through hole 41*b* is provided on cap 41. The through hole 41*b* in cap 41 is provided on cap keel 42. Then, the aforesaid through hole 41*b*, valve 43 is fitted. The aforesaid valve 43 being formed with plastic material, it can produce a state which is closed from the atmosphere without any pressure exerted on valve 43. Here, the reason why valve 43 can properly function as a valve is that while cap keel 42 is formed with rigid material as described earlier, the contact face between valve 43 and cap keel 42 is formed with excellent precision.

Next, around valve 43, valve cover 44 is mounted to enclose valve 43, and cap keel 42 and valve cover 44 are closedly fixed. Further, valve cover 44 is closedly coupled with wast ink tube 45. Cap 41 begins to approach recording head 38 from the state shown in FIG. 10 by the rotation of cam gears 59*a* and 59*b* in the direction indicated by arrow d in FIG. 10A. Along the movement of the aforesaid cam gear 59*a* and 59*b*, the sides of cap 41 begin to move in the directions indicated by arrow c in FIG. 10B and FIG. 10C while maintaining contact with front head plate 38*c*. This movement occurs because the sides of cap 41 are formed to open as the cap is raised upwards. Now, cap 41 is moved in the direction indicated by arrows c due to the shape of cap 41. In addition to this, it is due to the increasing pressure in the closed space in cap 41 resulting from the reduction of volume of the closed space in cap 41. As the pressure in the closed space in cap 41 increases, valve 43 begins to open, and air in the closed space begins to flow from valve 43 and waste ink (not shown) begins to flow towards waste ink tube 45. Further, FIG. 12 illustrates the state where cam gears 59*a* and 59*b* have rotated in the direction indicated by arrow d.

Figure 12B:
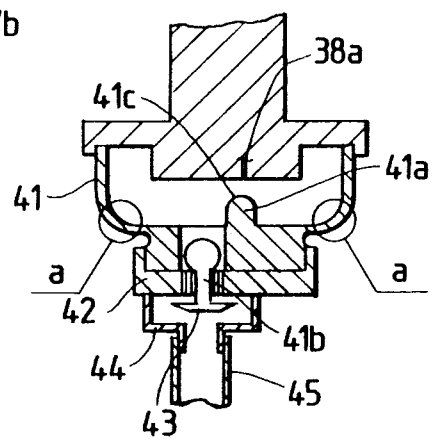
Figure 12A:
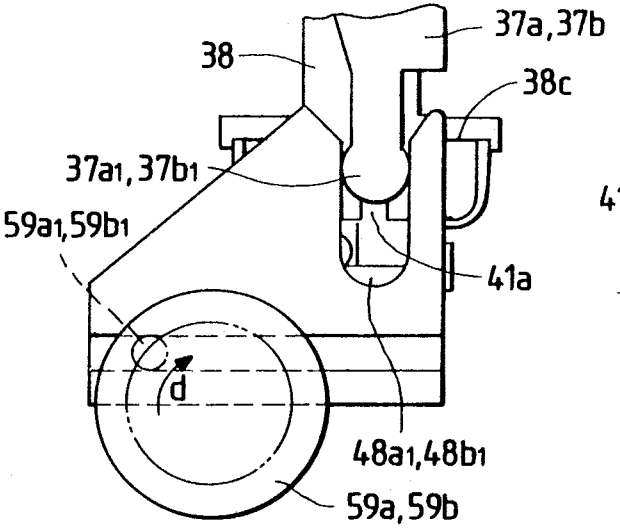

In FIG. 12B, the side of cap 41 is in contact with the rising portion of the edge of front head plate 38*c* and the movement in the direction indicated by arrow c in FIG. 10 is stopped. The side of cap 41 in the transverse direction shown in FIG. 12C is formed thinner than the thickness of the side in the longitudinal direction as described earlier. Therefore, its movement in the direction indicated by arrow c is stopped by the rigidity of the side itself. In the present embodiment, the thickness of the side of cap 41 shown in FIG. 12C is changed as described earlier, but if the thickness of the side of cap 41 in the transverse direction is made thin as in the case of the thickness of the side in the longitudinal direction as described above, the same faction as the present embodiment can be materialized by allowing the side to be in contact with the rising portion of the edge of front plate 38*c*.

Now, in FIG. 12B, the portions a of the sides of cap 41 are deformed as shown in FIG. 12B due to bending stress generated after the sides of the cap are in contact with the edges of front head plate 38*c*. The thick portions including the contacting faces of the sides of cap 41 receive buckling load, and the aforesaid portions a, being deformed to bend, are not buckled. This results in the similar deformation taking place in the sides of cap 41 including the portion b in FIG. 12C which is also being deformed. Here, in FIG. 12C, compression spring 47*a* has not been pressed as yet.

In FIG. 12B, the pressure in the aforesaid closed space generated by cap 41 becomes higher than the pressure in the state represented in FIG. 10, and valve 43 is released to flow air in the closed space in cap 41 and the aforesaid waste ink to waste ink tube 45.

In this respect, when cam gears 59*a* and 59*b* are further rotated in the direction indicated by arrow d, cap 41 further approaches head 38 and the projection 41*a* of cap 41 contacts nozzle 38*a*. Here, there is almost no deformation of cap 41 with the exception of projection 41*a*. Also, when cam gears 59*a* and 59*b* are still further rotated in the direction indicated by arrow d, compression spring 47*a* begins to deform, and the reaction generated by the aforesaid compression spring 47*a* causes projection 41*a* of cap 41 to press nozzle section 38*a*. In this respect, only compression spring 47*a* is illustrated in FIG. 10 through FIG. 15, but the other compression springs 47*b*, 47*c*, 47*d*, and 47*e* function in the same way as compression spring 47*a*. Here, the time needed for the aforesaid projection 41*a* to press nozzle 38*a* is approximately several seconds which are required for liquid ink to circulate in head 38. At this juncture, a pump is actuated to circulate liquid ink.

In the above-mentioned embodiment the cap 41 and the projection 41*a* are integrally formed of an elastic material such as rubber. However, the cap 41 may be a member separate from the projection 41*a* and the whole body of the cap 41 does not have elasticity. At least the head discharge port surface 38*c* and the contact section may be elastic and in this case a remaining upper part thereof may be of steel.

Now, FIG. 13 illustrates the state where compression spring 47*a* is deformed as the above describes, and boss sections $59a_1$ and $59b_1$ of cam gears 59*a* and 59*b* are positioned at the top. In FIG. 13, there is almost no volume change in the closed space formed by the cap 41, and valve 43 only shows the state to close air. Therefore, the pressure in the closed space is equal to the atmospheric pressure. Hereinafter, the state of each part, when cam gears 59*a* and 59*b* are rotated from the state shown in FIG. 13 in the direction indicated by arrow e, will be described. Now, the rotational direction of cam gears 59*a* and 59*b* means the required movement of boss sections $50a_1$ and $59b_1$ from the top to the bottom or from the bottom to the top as shown in FIG. 13, and even if, for example, cam gears 59*a* and 59*b* are rotated in the direction reverse to that indicated by arrow c in FIG. 13, the movements described below should take place in the same manner. In FIG. 14, the volume in the closed space in cap 41 is again increased and the pressure in the closed space becomes negative against the atmosphere, and valve 43 is closed as shown in FIG. 14. Therefore, in order to supplement the reduced volume in the closed space in cap 41, ink is discharged from nozzle section 38*a* of recording head 38. Ink remaining in nozzle section 38*a* is refreshed.

Finally, FIG. 15 illustrates the pheripheral parts including cap 41 being in the standby state where an apparatus according to the present invention has not started performing an operation such as recording, recovering, etc. In FIG. 15, the cam gears are at rest. In FIG. 15B, the pressure in the closed space in cap 41 is identical to the atmospheric pressure. At this juncture, there is no force exerted on valve 43 either to open or close to valve 43. However, due to the shape of valve 43, water vapor in the closed space in cap 41 is not released into the atmosphere.

Figure 15C:
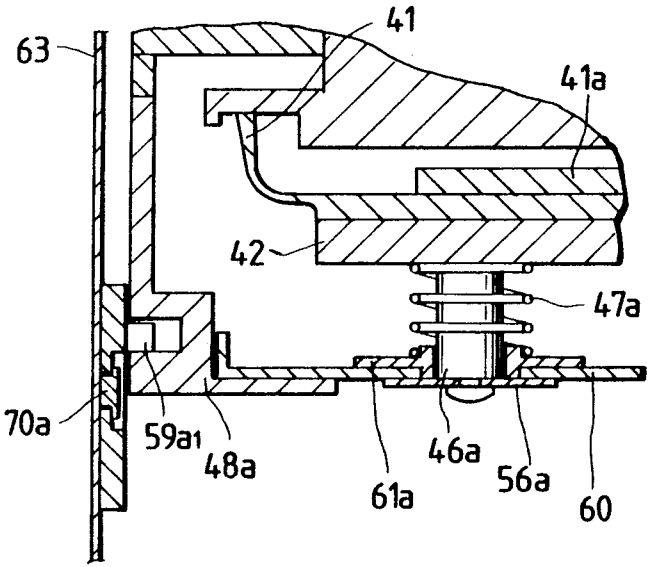
FIGS. 15A–15C are views showing the standby state of the cap.
Figure 15B:
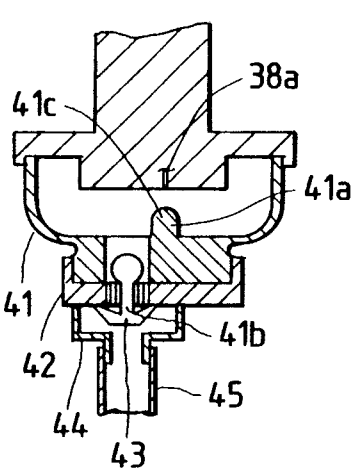
Figure 15A:
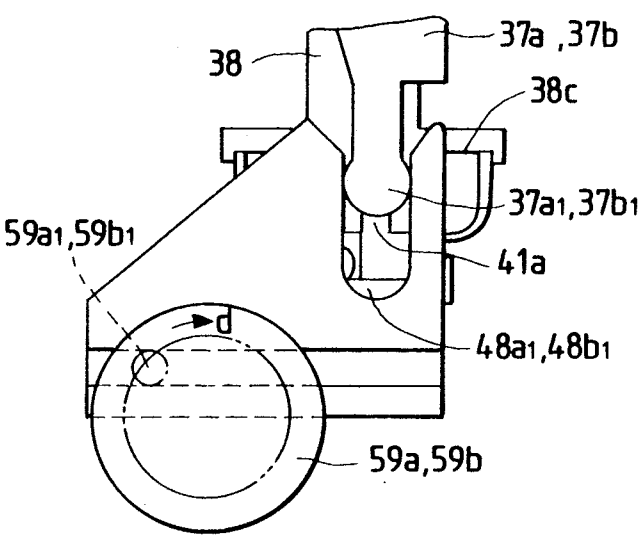
Figure 15E:
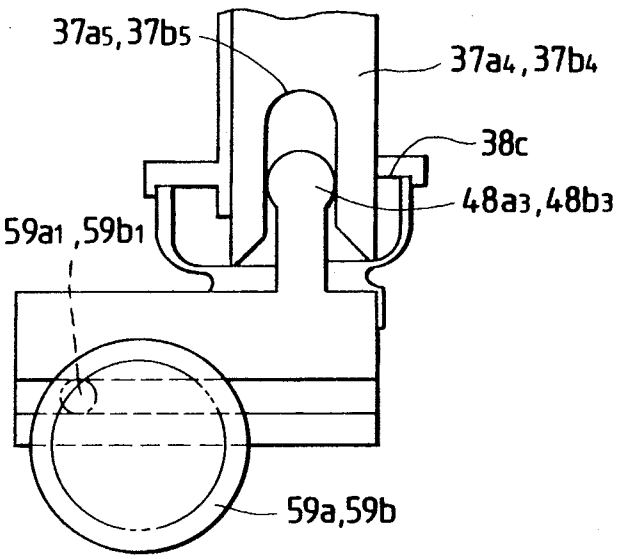
FIG. 15E is a view showing a guide member according to still another embodiment of the present invention.
Figure 15D:
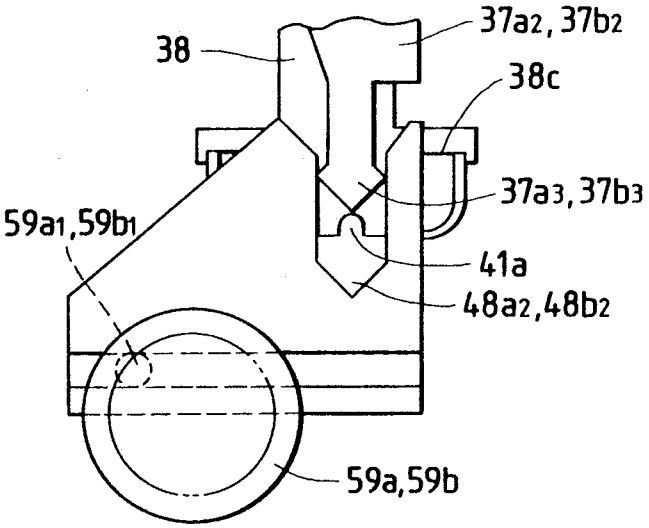
FIG. 15D is a view showing a guide member according to another embodiment of the present invention.

FIG. 15D is a view showing another embodiment of the guide member according to the present invention. On first cap guide 48*a* and second cap guide 48*b*, V letter holes $48a_2$ and $48b_2$ are respectively formed, and the spaces in V letter holes are formed with excellent precision.

Next, on first head arm 37*a* and second head arm 37*b*, square projections $37a_3$ and $37b_3$ are respectively formed, and the widths of the aforesaid projections are formed to fit exactly the spaces of the aforesaid V letter holes respectively.

Then, first head arm $37a_2$ and second head arm $37b_2$ are arranged to allow the leading ends of square projections thereof $37a_3$ and $37b_3$ to mate respectively with V letter holes $48a_2$ and $48b_2$ when the projection of cap 41 is in contact with nozzle section 38*a* of head 38.

With a structure such as this, even if there is a slight difference in the positions of the aforesaid V letter holes $48a_2$ and $48b_2$ and the aforesaid square projections $37a_3$ and $37b_3$, recovery frame 60 enables the holes $48a_2$ and projection $37a_3$ and the hole $48b_2$ and projection $37b_3$ to be mated reliably because the frame can displace itself in the directions indicated by $\theta$ and $\gamma$ in FIG. 9.

FIG. 15E is a view showing still another embodiment of guide member according to the present invention. On first head arm $37a_4$ and second head arm $37b_4$, U letter holes $37a_5$ and $37b_5$ are respectively formed, and the spaces of U letter holes are formed with excellent precision.

Next, on first cap guide 48*a* and second cap guide 48*b*, circular projections $48a_3$ and $48b_3$ are respectively formed, and the widths of the aforesaid circular projections are formed to fit exactly the spaces of the aforesaid U letter holes.

Then, first head arm $37a_4$ and second head arm $37b_4$ are arranged to allow the leading ends of U letter holes $37a_5$ and $37b_5$ to fit circular projections $48a_3$ and $48b_3$ respectively when the projection of cap 41 is in contact with nozzle section 38*a* of head 38.

With a structure such as this, even if there is a slight difference in the positions of the aforesaid circular projections $48a_3$ and $48b_3$ and the aforesaid U letter holes $37a_5$ and $37b_5$, recovery frame 60 enables the projection $48a_3$ and hole $37a_5$ and the projection $48b_3$ and hole $37b_5$ to be mated reliably because the frame can displace itself in the directions indicated by arrows $\theta$ and $\gamma$ in FIG. 9.

Next, the ink supply and recovery systems will be described. This unit comprises an ink tank, ink tubes, an ink pump, etc. to keep ink and supply it regularly to a recording head and to remove bubbles generated in the tubes, etc., as well as anything that may clog nozzles.

Figure 16:
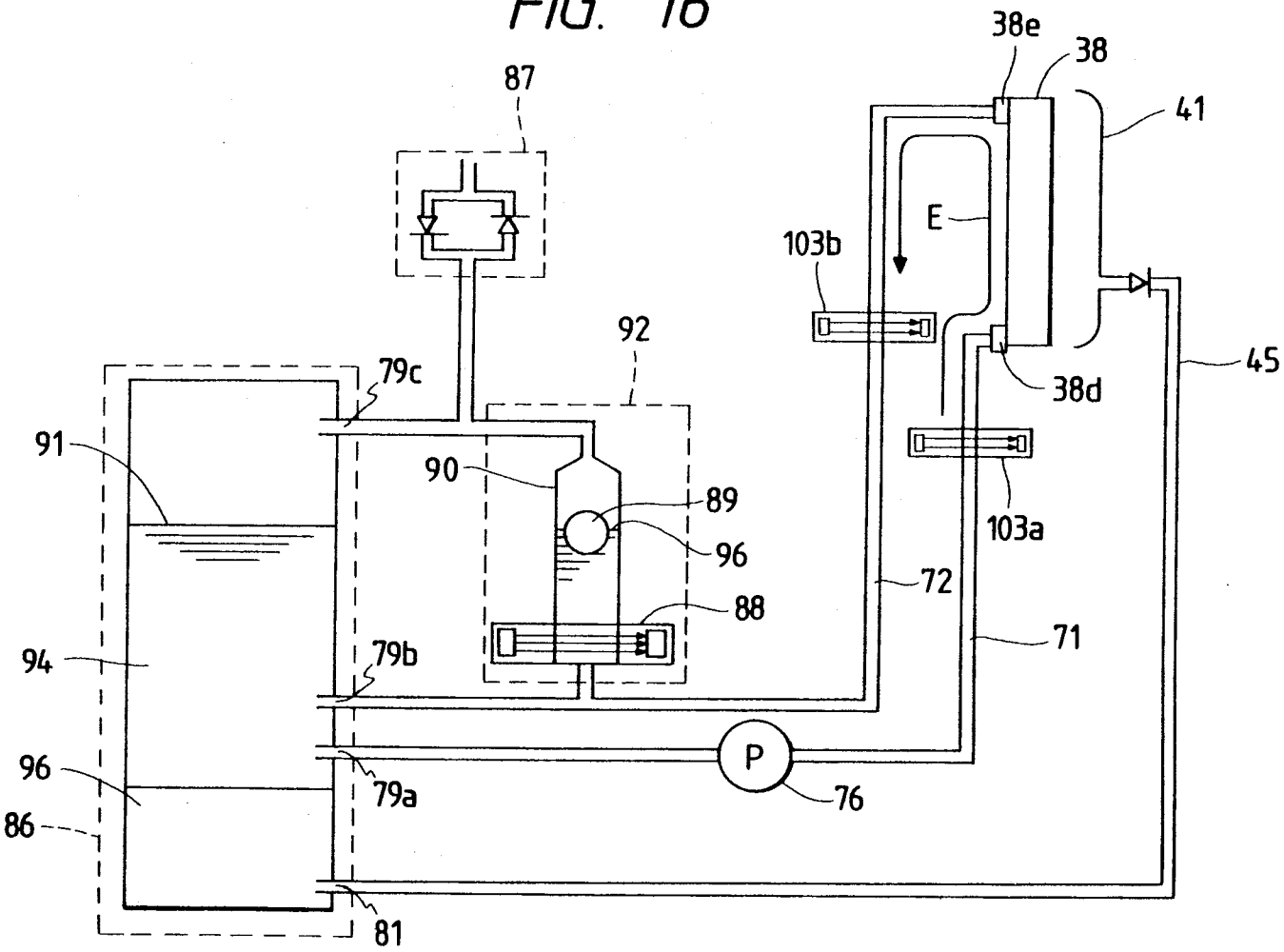
FIG. 16 is a typical view schematically showing a structural example of the ink supply passage of an ink jet recording apparatus according to the present invention.

FIG. 16 is a view illustrating the concept of an embodiment according to the present invention. In FIG. 16, an ink cartridge camprises recording head 38, ink pump 76, ink tank 86, waste ink absorber 96, and air duct 87 which is called breezer.

The initial ink supply to recording head 38 is carried out in a manner given below. In other words, ink pump 76 is actuated in a state where cap 41 is closely contacted with the recording head (a state shown in FIG. 13 where projection 41*a* in cap 41 is in contact with nozzle section 38*a* of recording head 38) to circulate ink from ink cartridge 86 in the direction indicated by arrow E, so that the inside of the tubes including the inside of the recording head is filled with ink. At this time, some ink flows to cap 41, but it is returned to ink cartridge 86 through waste ink tube 45 and collected by built-in ink absorber 96.

When the initial ink supply is completed, recording head 38 is ready to discharge ink. The ink pump used in the present embodiment, however, is a pump which does not close the flow passage when the pump is at rest. Therefore, the ink supply at the time of discharging is carried out from both front and rear head ink couplers 38*d* and 38*e*.

When ink is reduced due to discharging, air should be drawn into the tank in an amount equal to the reduced amount of ink. Breezer 87 functions as an air duct for this purpose. In this breezer 87, check valves capable of being opened by an extremely small difference in pressures are respectively arranged in both directions. Therefore, the valves function if a slight pressure, either negative or positive, is generated in the tank, and operate as air holes substantially. However, the valves are also arranged to control dust intrusion and evaporation.

A reference numeral 92 designates a no-ink detector for detecting no-ink condition in tank 94. The detection is carried out in a manner given below. In other words, since float chamber 90 is open to the atmosphere through breezer 87 which is commonly provided for ink tank 94, the liquid level therein and float 89 which floats thereon indicate the same water level 91*a* as liquid ink level 91 in ink tank 94. Therefore, at an appropriate location in the lower part of float chamber 90, sensor 88 is arranged for detecting a light interruption. Thus, when liquid level 91 is lowered, i.e., float 89 is lowered following the lowering of water level 91*a* in the area for detection, the emitting light from the sensor 88 is interrupted, thereby detecting the no-ink condition.

Next, the recovery operation is described. The recovery operation is an action to remove bubbles and clogging which bender the normal discharging, and is performed in accordance with the recovery sequence, which will be described later, controlled by the recovery system. The recovery operation, however, is exactly the same as the initial ink supply operation. In other words, ink pump 76 is actuated while cap 41 is in contact with recording head 38 (the current state is illustrated in FIG. 13) to circulate ink in the direction indicated by arrow A, so that bubbles are collected into the ink tank to release them to the outside through the breezer. Also, the contacting condition between projection 41*a* in cap 41 and nozzle 38*a* is released to drive the pump for the removal of any clogging in the nozzle. At this time, pressurized ink flows into float chamber 90. Then, float 89 is raised to closely contact with upper face of float chamber 90 to cover the passage to breezer 87. Therefor, no ink flows into breezer 87.

Figure 17:
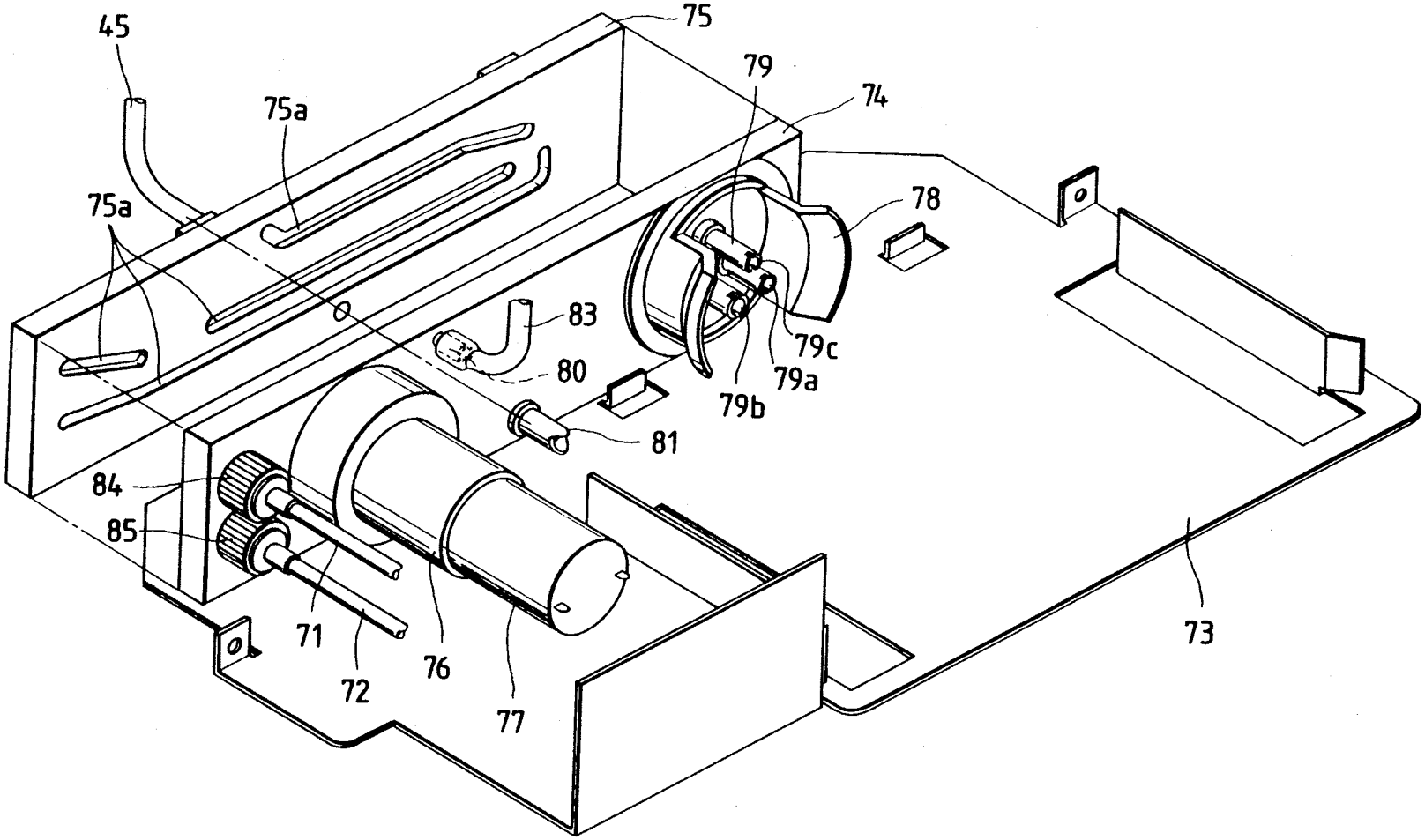
FIG. 17 is a perspective view showing a structural example of ink supplying means of an ink jet recording apparatus according to the present invention.

FIG. 17 is a perspective view showing the construction of supply and recovery systems, in which the structure of the present embodiment is actually employed. In FIG. 17, a reference numeral 73 designates the base of this unit which also functions as a base for installing ink cartridge 86, which will be described later. Also, a reference numeral 74 designates a joint plate which is formed by fixing each of various passage couplers. To this joint plate 74, there are coupled cartridge guide 78 for positioning ink cartridge 86, cartridge joints 79*a*, 79*b*, and 79*c* for connecting tubes to release air, waste ink joint 81 for guiding waste ink produced at the time of recording to waste ink absorber 96 built in ink cartridge 86 through waste ink tank, air joint 80 for connecting the breezer for releasing air with air tube 83, first and second supply tube joints 84 and 85 for connecting first and second ink supply tubes 71 and 72 with ink pump 76 which is driven by pump motor 77. Thus, ink joint 79 connected to ink tank 94 accommodated in ink cartridge 79*a* provides three functional sections intensively, first ink supply section 79*a*, second ink supply section 79*b*, and air passage connecting section 79*c*, and with its structure, enables first ink supply inlet 95*a*, second ink supply inlet 75*b* and air inlet 95*c* to be coupled altogether, which are operationally related to the function of ink tank 94.

For this purpose, the air passage section leading to the ink tank is formed by joints, thereby making it possible to construct the ink tank with hard resin material to reserve a large quantity of ink without employing ink bags.

Furthermore, by connecting first ink supply inlet 95*a* and second ink supply inlet 95*b*, and ink supply section 79*c* and second ink supply section 79*b*, an ink circulation passage is formed to perform ink supply from both of the ink supply regions at the time of recording and to circulate ink from the ink tank through the passage with the pump inbetween, and to circulate ink from the recording head to the ink tank again at the time of initial ink filling and recovery operation.

In other words, since the passage is formed by directly joining the tank and the supply passage, and further the air passage as described earlier, it becomes possible to eliminate, in spite of the ink tank being made of hard plastic resin, such function as a sub-tank which has conventionally been indespensable for a stable ink supply. In the present embodiment, these members are separately fixed to joint board 74, but the structure may also be such that these members are integrally formed with the joint board.

Further, to joint board 74, flow passage board 75 is coupled with flow passage gloove 75*a* which functions as ink flow passage. In this portion, most of the ink flow passage pipings and connections are installed.

In other words, by fixedly arranging joint section 79 which is annexed to joint board 74 connected to ink tank 94, it becomes possible to provide a structure thereby eliminating the operation related to ink passage 75*a* in that particular portion.

As a result, a part of ink passage from ink tank 94 to the recording head can be formed only by coupling to the reverse side of joint board 79 the flow passage plate 75 which constitutes a flow passage.

On the other hand, as described later, ink tank 94 built in ink cartridge 86 is flexibly accommodated in housings 93*a* and 93*b* which constitute the cartridge 86.

By accommodating the ink tank flexibly, it is possible to reliably adjust with ease the coupling condition of the cartridge which should be installed against joint section 79 which is flexibly arranged, and in this way, the installation of the cartridge is carried out with assurance.

It is also possible to construct the ink passage from the ink tank without complicated piping arrangements simply by coupling joint board 74 and flow passage plate 75 to form the required flow passage.

Figure 18:
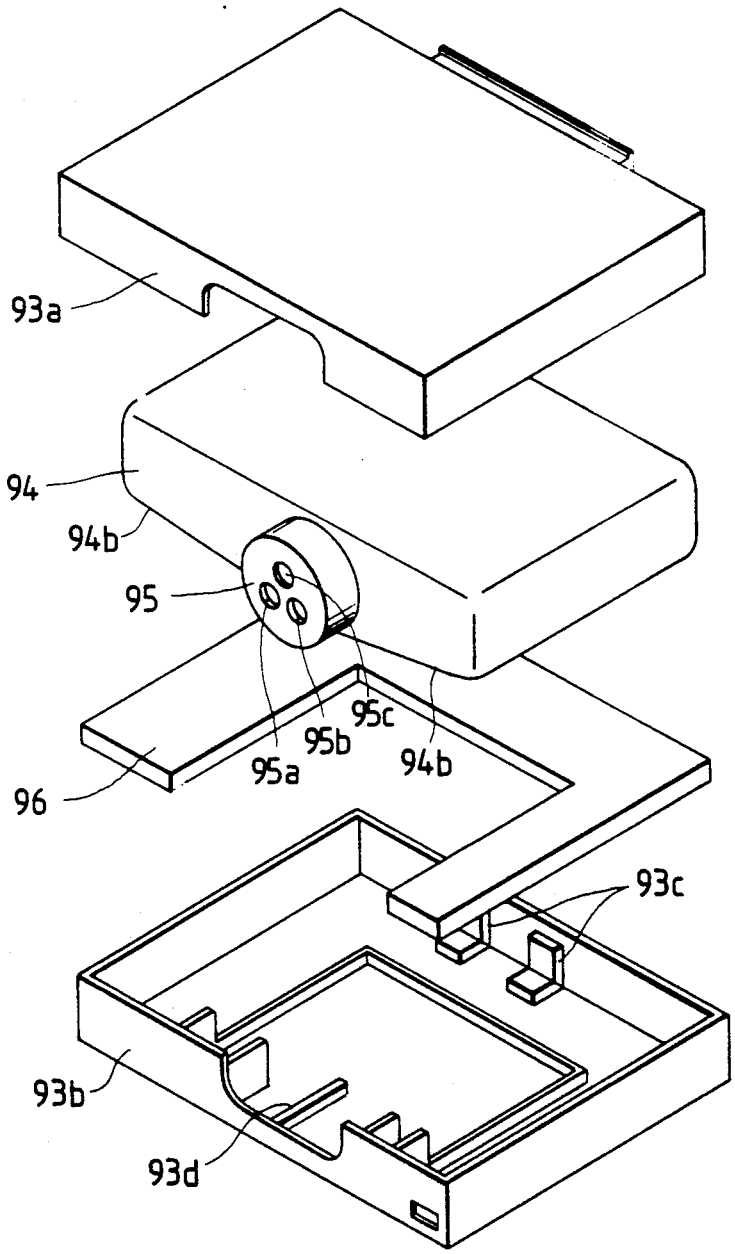
FIG. 18 is an exploded perspective view showing a structural example of an ink cartridge installed in an ink jet recording apparatus according to the present invention.

As shown in FIG. 18, there is accommodated in ink cartridge 86 having common housings 93*a* and 93*b* made of material having a good impact resistance, ink tank 94 made of resin having a good property against fluid and waste ink absorber 96 made of a water absorptive material having an excellent ink absorptive property such as felt or porous material. The ink supply and air releasing are performed by connecting these members with cartridge 79 on the side of joint plate 74 through joint section 95. Thus, the entire ink cartridge 86 is structured to be detachably installed as a whole on base 73 provided on the side of the apparatus.

Figure 19A:
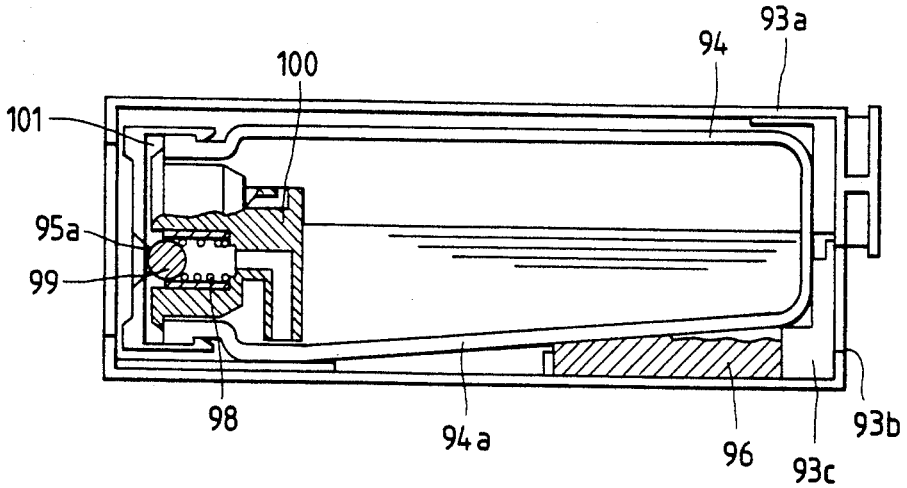
FIGS. 19A and 19B are a partially cutaway sectional side view showing the structural example of the ink cartridge and a partially enlarged view thereof to show the state of mating with the ink supplying means.
Figure 19B:
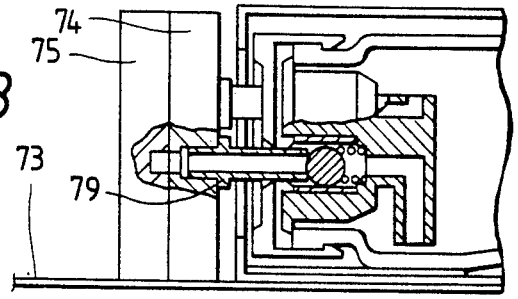

FIGS. 19A and 19B illustrate the structure of this part in further detail. FIG. 19A is a partially cutaway cross-sectional side view showing the principal parts of ink cartridge main body 86. FIG. 19B is a partially cutaway cross-sectional view showing joint section 95 connected to the cartridge joint of the ink supply system. In order to prevent any ink leakage when ink cartridge 86 is removed, metal ball 99 is provided in joint section 95 to press it against joint opening 95*a* by the compression of spring 98. When the ink cartridge is detached from the unit, the metal ball 99 is in close contact with sheathing rubber 101 to close the opening 95*a* of the joint section.

Figure 20:
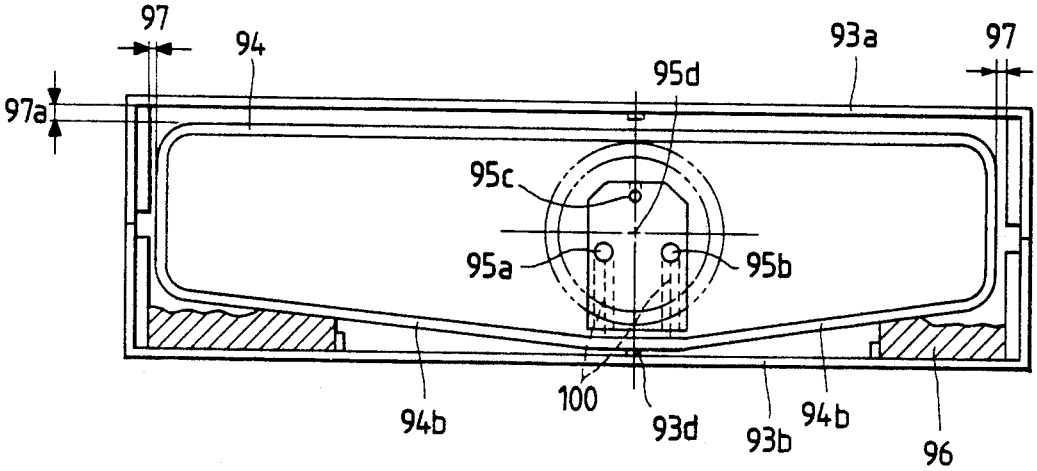
FIG. 20 is a partially cutaway sectional front view of the structural example of the ink cartridge.
Figure 21:
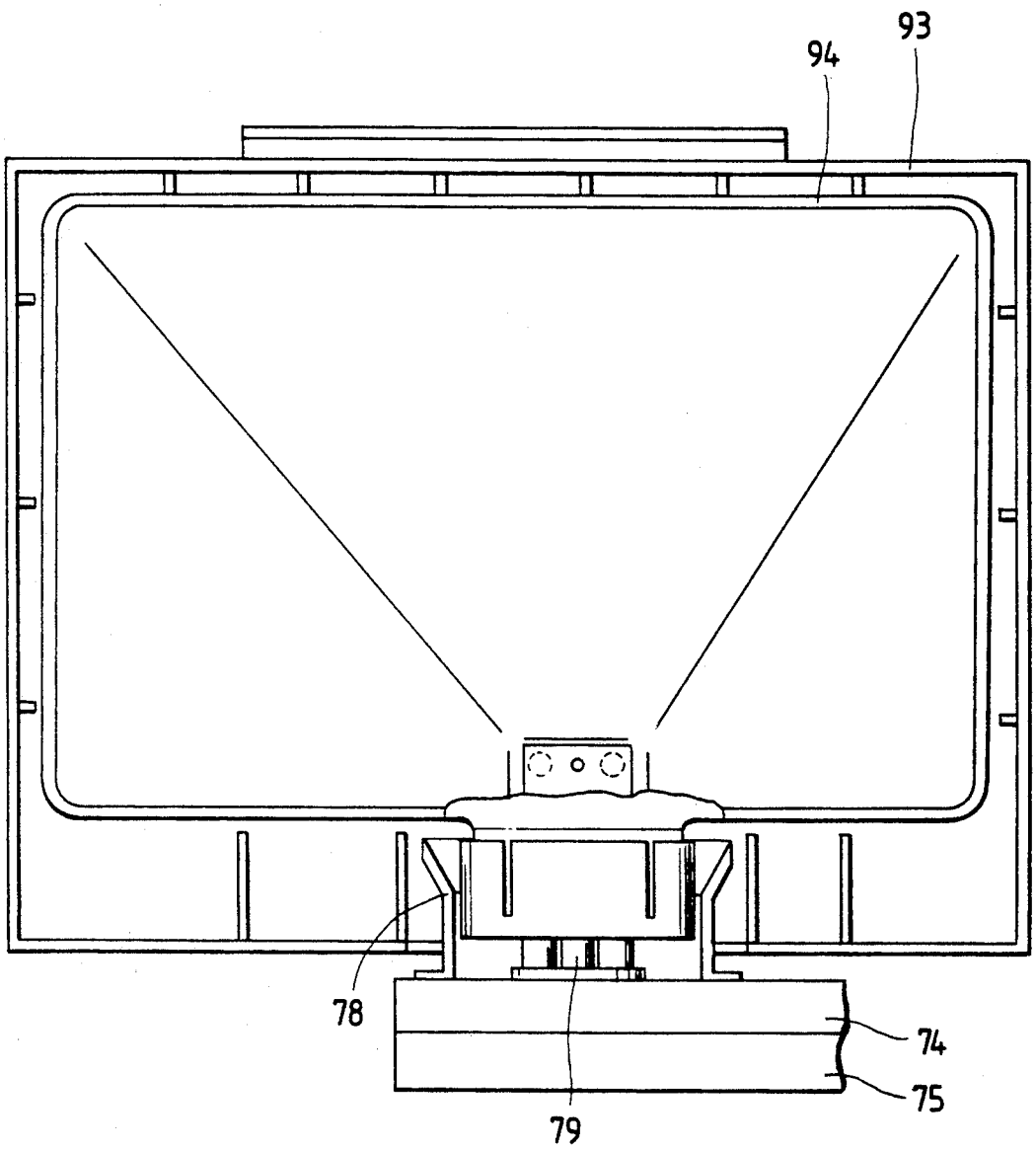
FIG. 21 is a schematic top view showing the structural example of the ink cartridge.

Also, as shown in FIGS. 19A and 19B and FIG. 20 showing the front cross-section of ink tank, the ink tank has sloped surfaces or slants 94*a*, 94*b* at its bottom. In other words, there are provided slant 94*a* for gathering ink flow into joint section 95 from behind, and slant 94*b* for gathering ink flow into joint section 95 from the side of ink tank 94. Ink is supplied to the ink supply system through guiding tube 100 which is bent to be opened at the lowest bottom of the ink tank. A bottom support 93*b* supports the rear portion of the sloped surface 94*a* of the ink tank 94. Thus, it is possible to collect all ink in the vicinity of guiding tube 100 by forming slants 94*a* and 94*b* at the bottom of the ink tank, and to use ink without any waste. Also, it is possible to draw ink without waste even if the apparatus is installed with a slight inclination. With a structure such as this, the area is provided in the housing to accommodate the aforesaid waste ink absorber 96 substantially in U shape.

Furthermore, in the present embodiment, it is necessary to couple three flow passages, i.e., two ink supply passage and one air releasing passages, in joint section 95, but in order to obtain reliable couplings, ink tank 94 is held in housings 93*a* and 93*b* as shown in FIG. 20 with space 97 to allow the ink tank to move freely in an appropriate amount.

Especially, it is necessary to provide flexibility not only vertically and horizontally but rotatably when a plurality of joints should be connected. In the present embodiment, a slight rotatability is maintained to obtain a rotatable flexibility against the central axis of joint section 95 by supporting ink tank 94 with spaces 97 (in this embodiment, for example about 1.0 mm) and spaces 97*a* (for example, about 1.0–2.0 mm) provided for both ends of ink tank 94 and by waste ink absorber 96 which is soft like felt. A projection 93*d* supports a front bottom of the ink tank 94. Hence it is possible to make connections reliably without any deviations in positioning. In this embodiment the joints 95*a*, 95*b* and 95*c* of the ink tank are provided about 0.5 mm lower with respect to the body joints 79*a*, 79*b* and 79*c* so that the ink tank 94 is connected to the body joints in a state which it floats about 0.5 mm to the body joints. Furthermore, in order to prevent any abnormal sound generated by the movement of ink tank 94 by vibrating impact, etc. or breakage of housing as well as to effectively utilize space, the central part of waste ink absorber 96 is removed as shown in FIG. 18 to allow the lov' st bottom ink tank 94 to be fitted into the removed part, so that the ink tank is held by the remaining portion of the absorber. With this structure, impact can be absorbed by the softness of waste ink absorber 96 and the required flexibility is maintained. In this way, the ink tank is protected from the external impact and the clattering of the ink tank is also prevented because in this structure the waste ink absorber is fitted at the lowest bottom of the ink tank and at the same time, the ink tank is held by soft material such as felt of the circumferential portion of the waste ink absorber.

Figure 22:
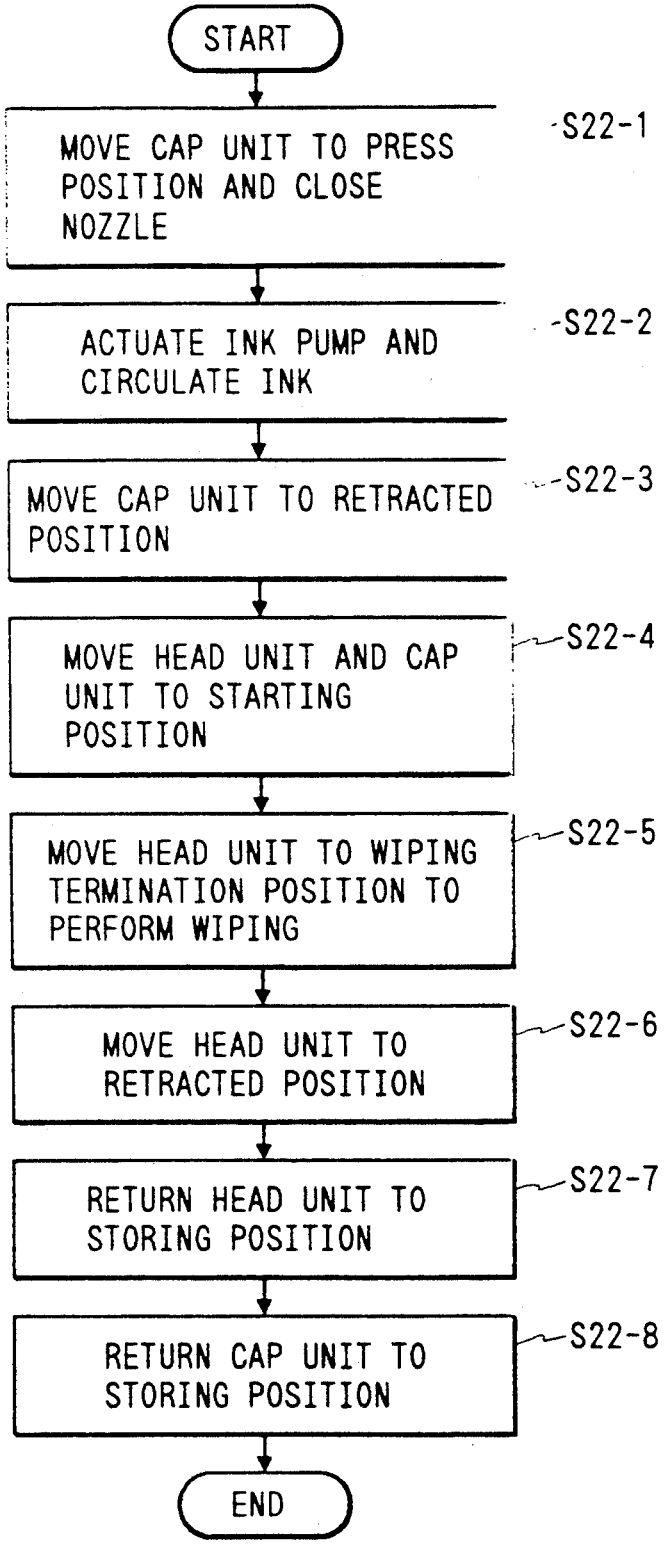
FIG. 22 is a flowchart showing an example of sequential recovery applicable to an ink jet recording apparatus according to the present invention.

Next, the recovery sequence will be described. The recovery operation is needed to maintain a normal recording. With this operation which is performed by the linkage of a recovery system and an ink supply system, bubbles and cloggings in the flow passage are removed. FIG. 22 is a flowchart showing this operation. FIGS. 23A through 23D are schematic views showing the system in operation. In FIGS. 23A through 23D, for the purpose of simplifying description, a unit comprising recording head 38, head arms, etc. is defined as head unit 65, another unit comprising cap 41, wipers 50 and 52, recovery frame 60, etc. is defined as cap unit 64. Head unit 65 is rotatable with head shaft 36 as its rotating center while cap unit 64 is rotatable with recovery frame shaft 55 as its rotating center. Hereinafter, the sequence of the recovery operation will be described.

In the normal standby state, the relationship between recording head 38 and cap 41 is, as has been already described, that the closed state is maintained as shown in FIG. 15 by slightly bending the periphery of the cap. The recovery operation begins as shown in FIG. 12 with pressing projection 41*a* in cap 41 against nozzle 38*a* arranged on the top of the recording head by rotating cam gears 59*a* and 59*b* (the cap unit position at this juncture is referred to as press position) (S22-1). Next, in this state, ink pump 76 is actuated to circulate ink in the supply passage (S22-2) and remove bubbles in the tube. Projection 41*a* is pressed against nozzle 38*a* in order to prevent ink from being flown out from the nozzle because otherwise a part of ink is not circulated by the pressure generated by the ink pump and flown out of the nozzle as useless waste ink.

Figure 23A:
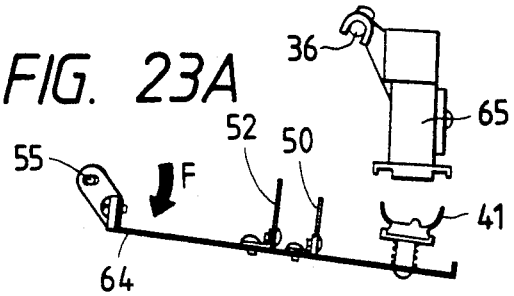
FIGS. 23A-23D are schematic side views sequentially showing the recovery operation.
Figure 23B:
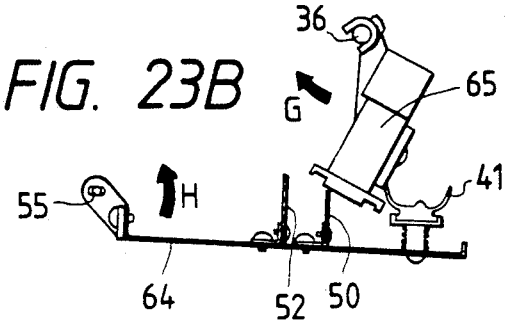
Figure 23C:
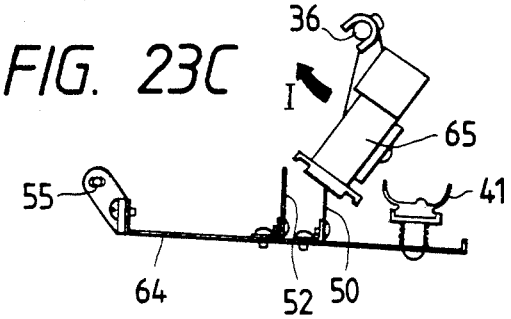

Next, as indicated by arrow F in FIG. 23A, cap unit 64 descends (this state is referred to as retracted position) (S22-3), and further head unit 65 is rotated as indicated by arrow G in FIG. 23B while cap unit 64 is rotated as indicated by arrow H in FIG. 23B to be in the wiping starting position (S22-4). Subsequently, head unit 65 is rotated as indicated by arrow I in FIG. 23C to clean off ink droplets, dusts, etc. on discharging port face 38*b* of the recording head with wipers 50 and 52 arranged in cap unit 64 (S22-5). Although FIG. 23C illustrates the state as indicated by arrow I where discharging port face 38*b* of the recording head is passing a first wiper, there are two wipers provided in the present embodiment. Therefore, when the cleaning off by a second wiper is terminated, cap unit 64 again descends to the retracted position as indicated by arrow J in FIG. 23D, and head unit 65 returns to the home position (S22-7). Then, finally, cap unit 64 ascends to the normal standby state as shown in FIG. 1 (S22-8) to complete the recovery operation.

The cleaning in the present embodiment will additionally be described. The recording head employed for the present embodiment has discharging ports formed across the entire recording width of the recording medium, i.e., the so-called full line type as described earlier. However, in the case where a discharging port face is extremely elongated as in the present embodiment, a sufficient cleaning cannot be performed with the use of one blade just for a one-time wiping. This is due to the difficulty in applying pressure by a blade equally all over the discharging port face, which is now too long for such a cleaning.

In the present embodiment, therefore, two blades, blade 50 and 52, are employed to clean off the discharging port face sequentially to obtain reliability in cleaning action.

Particularly, at the time of cleaning, it is important for the two blades to contact with the discharging port face of recording head each individually to perform cleanings, so that the effect of double-wiping should be obtained. With a sequential arrangement of two blades such as this, the cleaning time can be shortened as compared with the case where a cleaning action is taken twice with one blade. Also, in the present embodiment, the size of blade 50 which contacts the recording head first differs from the size of blade 52 which contacts it subsequently. The recording head rotates with head shaft 36 as its rotating center, and in order to place the leading end of the blade to be in contact with the discharging port face within the path of the recording head to move, it is necessary to define the length of each blade accordingly. Therefore, it is also possible to perform the required cleaning by driving the cap unit following the rotational movement of the recording head while making the length of each blades 50 and 52 the same or making the relational length of each of them reversed.

Figure 23D:
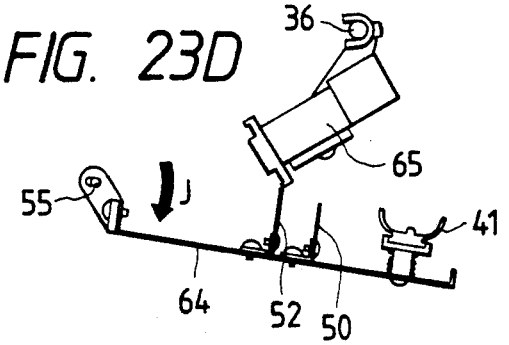
Figure 23E:
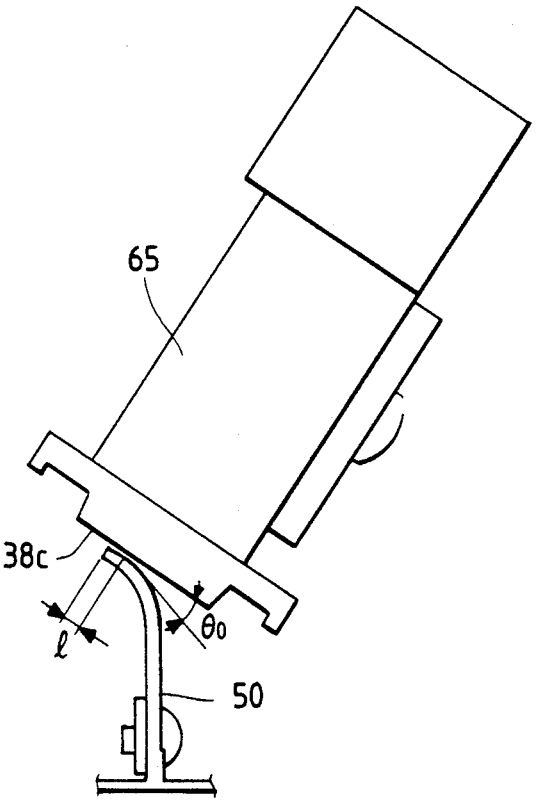
FIG. 23E is a typical view showing the contacting amount and contacting angle of the leading end of a blade being in contact with the face of a discharging port.

Also, by making the length of each of plural blades contacting the rotating head 38 different, it is possible to vary the length l of the leading end of the blade contacting the discharging port face 38*c* of the head and/or the contacting degree $\theta_0$ of each blade (FIG. 23E). Hence, it is possible to vary the force and area of each blade with which to contact discharging port face 38*c* to control possible splashing of adhered ink and dust on discharging port face 38*c* to the surrounding area at the time of cleaning off.

Also, by making the contacting amount and/or contacting angle $\theta_0$ of each blade against discharging port face 38*c* greater sequentially following the order in which each of the blades are in contact with discharging port face 38*c* of the head, it becomes possible to allow the first blades to contact discharging port face 38*c* lightly when there are more ink or dusts adhered thereto, which should be cleaned off and the later blades to contact it sufficiently to clean off the remaining ink and dusts. Consequently, while controlling the possible splashing of ink and dust adhered to discharging port face 38*c* to the surrounding area, it is possible to remove them completely.

Furthermore, when the first blade wipes discharging port face 38*c*, the rest of blades function as protective wall (FIG. 23C) to prevent the ink and dust removed by the first blade from being splashed to the surrounding area of the recovery system and eliminate the causes to stain the recording sheet or to electrically short circuit an electronic circuit board.

In this respect, it is not necessary to limit the number of the blades for cleaning to two as described above, but more blades can also be employed. Also, although in the present embodiment, the same material is used for both blades 50 and 52, a same material but of different properties or different materials may be used to improve the cleaning effect.

Figure 24:
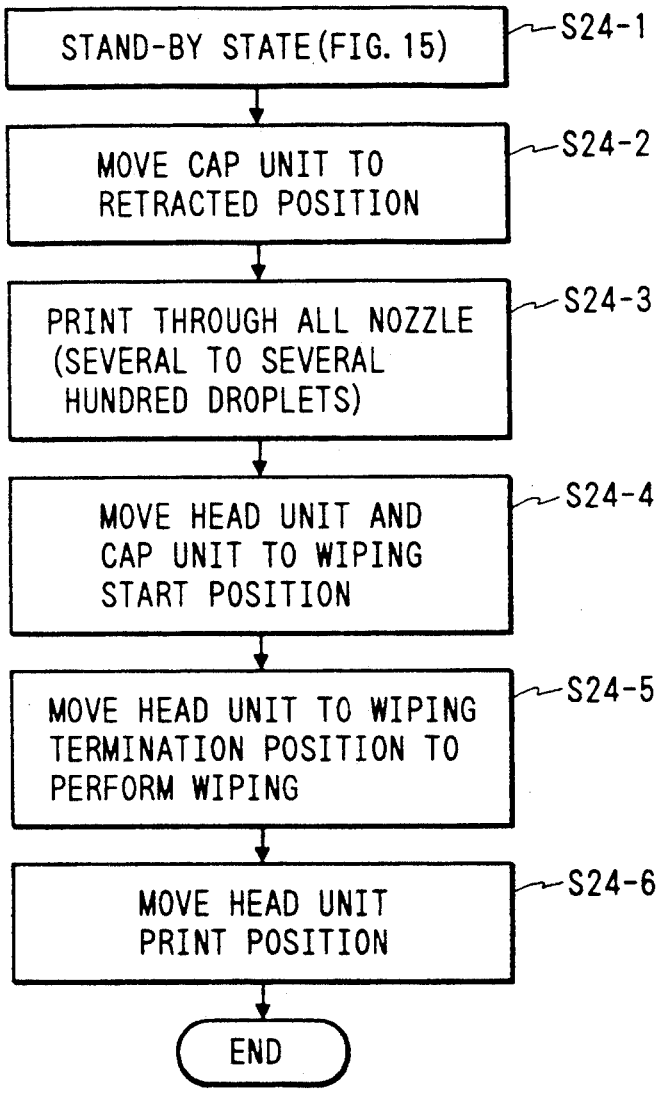
FIG. 24 is a flowchart showing an example of the sequence from the standby state to the recording state.

Next, referring to FIG. 24, the sequence at the starting time of recording will be described.

The recording is started in a manner given below. At first, a signal to start recording is received by the recording head at a step S24-1, the recording head at this juncture being in the standby state where only the cap covers the discharging port face of the recording head as shown in FIG. 15. Then, at a step S24-2, the cap unit is retracted to the state in which the recording head and the cap are set apart as shown in FIG. 11, i.e., the retracted position.

Subsequently, at a step S24-3, while maintaining the state shown in FIG. 11, a preparatory discharging of several ejections to several hundred ejections is effectuated from the entire nozzles of the recording head.

Hence, the discharging condition of the entire nozzles of the recording head is equalized.

Then, after the preparatory discharging is terminated, the cap unit and head unit are moved at a step S24-4 to constitute a starting condition of wiping action as shown in FIG. 23A. Then at a step S24-5, a series of wiping action is performed as shown in FIG. 23B through 23D, and at a step S24-6, the recording unit is moved further to the recording position as shown in FIG. 1 where such state is held. After that, recording signals are sequentially inputted to carry out recording as desired.

Next, the recovery operation which is executed by circulating ink will be described in further detail. In the present embodiment, as shown in FIG. 16, bubble sensor 103 (for example, a transmitting sensor, etc.) is provided to detect bubbles in the ink supply tubes. Accordingly, it is possible to perform two different types of recovery operations, i.e., an automatic recovery to be carried out periodically each at a predetermined time, and an occasional recovery to be performed when bubble sensor 103 detects any incidental bubble or bubbles. The occasional recovery becomes possible with the installation of bubble sensor 103, and with this, the incidental non-discharging hitherto experienced can be reduced, thereby making it possible to improve the reliability of the apparatus. Particularly, in consideration of the safety with which all bubbles are removed irrespective of the presence of bubbles, the amount and location thereof, a considerably excessive circulation time and number has been given to perform a sufficient removal of bubbles. In the present embodiment, however, bubble sensors 103*a* and 103*b* are provided at either sides of up and down streams of ink flow towards the recording head at the time of circulation. Therefore, if no bubbles are detected by either of the bubble sensors, the recovery action is immediately suspended. Particularly when bubble sensor 103*b* arranged at the down stream of ink flow at the time of circulation should detect a signal indicating that bubbles have been removed (no bubble presence), the ink pump is stopped after a while (a period required for the detected bubble exhausted to the tank from the current position of the sensor). Consequently, there is no need for providing any excessive circulation time as has been required conventionally, resulting in the termination of the recovery sequence in a shorter period of time. Also, there is an advantage that the reliability of bubble removal improves because the recovery action is terminated after no bubble presence has been detected. In this way, the amount of ink consumed for recovery becomes small, which leads to the prevention of no ink condition at the time of receiving the facsimile or of no reception state during the recovery operation.

Figure 25:
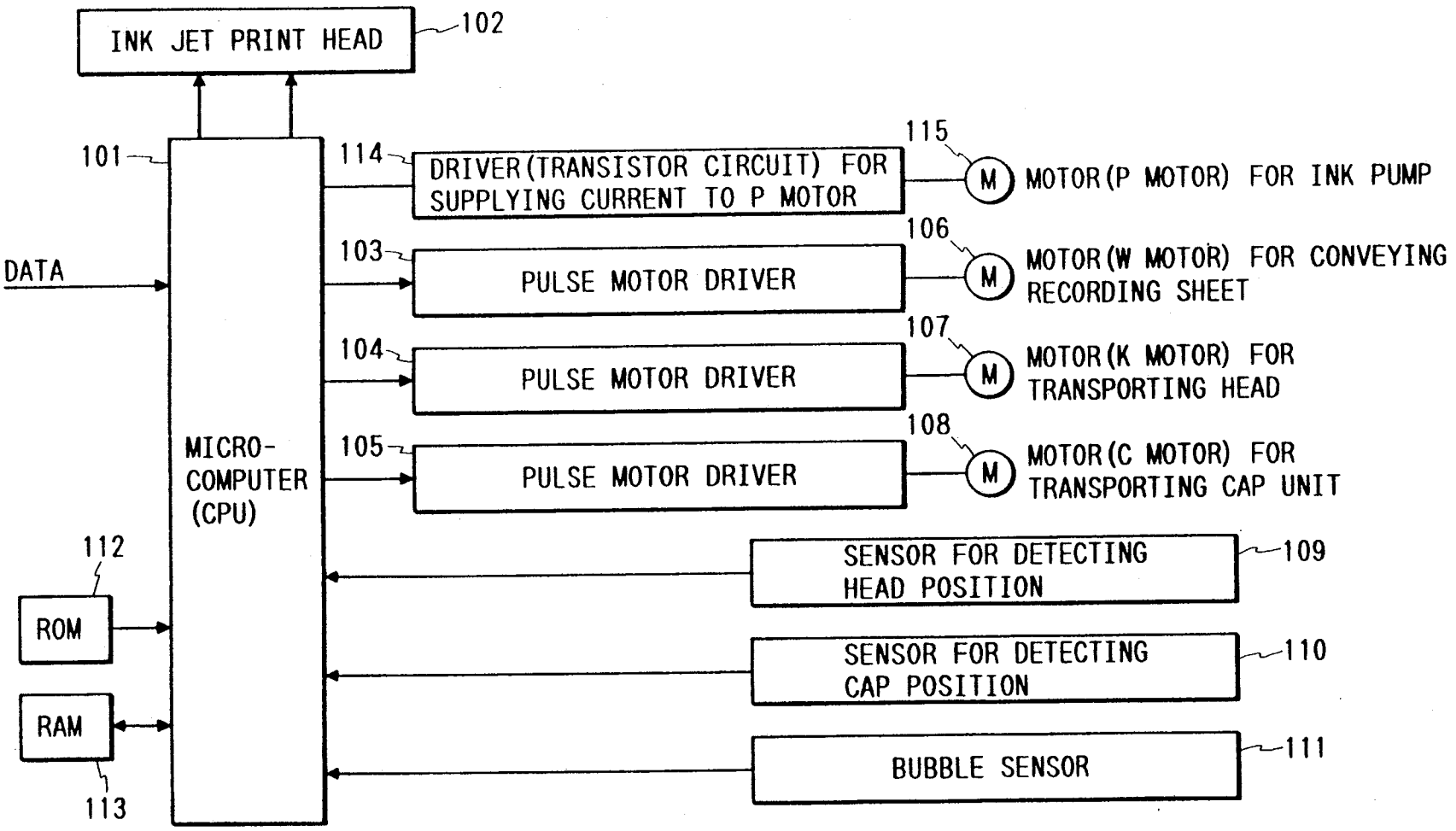
FIG. 25 is a block diagram showing a recording unit according to an embodiment of the present invention.

FIG. 25 is a block diagram showing the recording unit according to an embodiment of the present invention.

In FIG. 25, microcomputer (CPU) 101 controls the operation of the unit in accordance with the program stored in ROM 112 and data stored in RAM 113.

Ink jet print head 102 performs recording by control (strobe) signals from CPU after data for each a one-line portion has been received from CPU.

Drivers 103, 104, and 105 for each of pulse motors, which will be described later, supply appropriate currents to drive the motors respectively in accordance with step instructions from CPU.

Reference numerals 106, 107 and 108 designate respectively a motor (W motor) for conveying a recording sheet, a motor (K motor) for transporting the head, and a motor (C motor) for transporting the cap unit.

Head position detecting sensor 109 and cap position detecting sensor 110 detect the positions by means of on-off of microswitches, for example.

A reference numeral 111 designates a bubble sensor.

A motor (P motor) 115 for driving the ink pump is a DC motor which rotates when on. A driver (transistor circuit) 114 supplies current to turn on the P motor by a signal from CPU.

Figure 26:
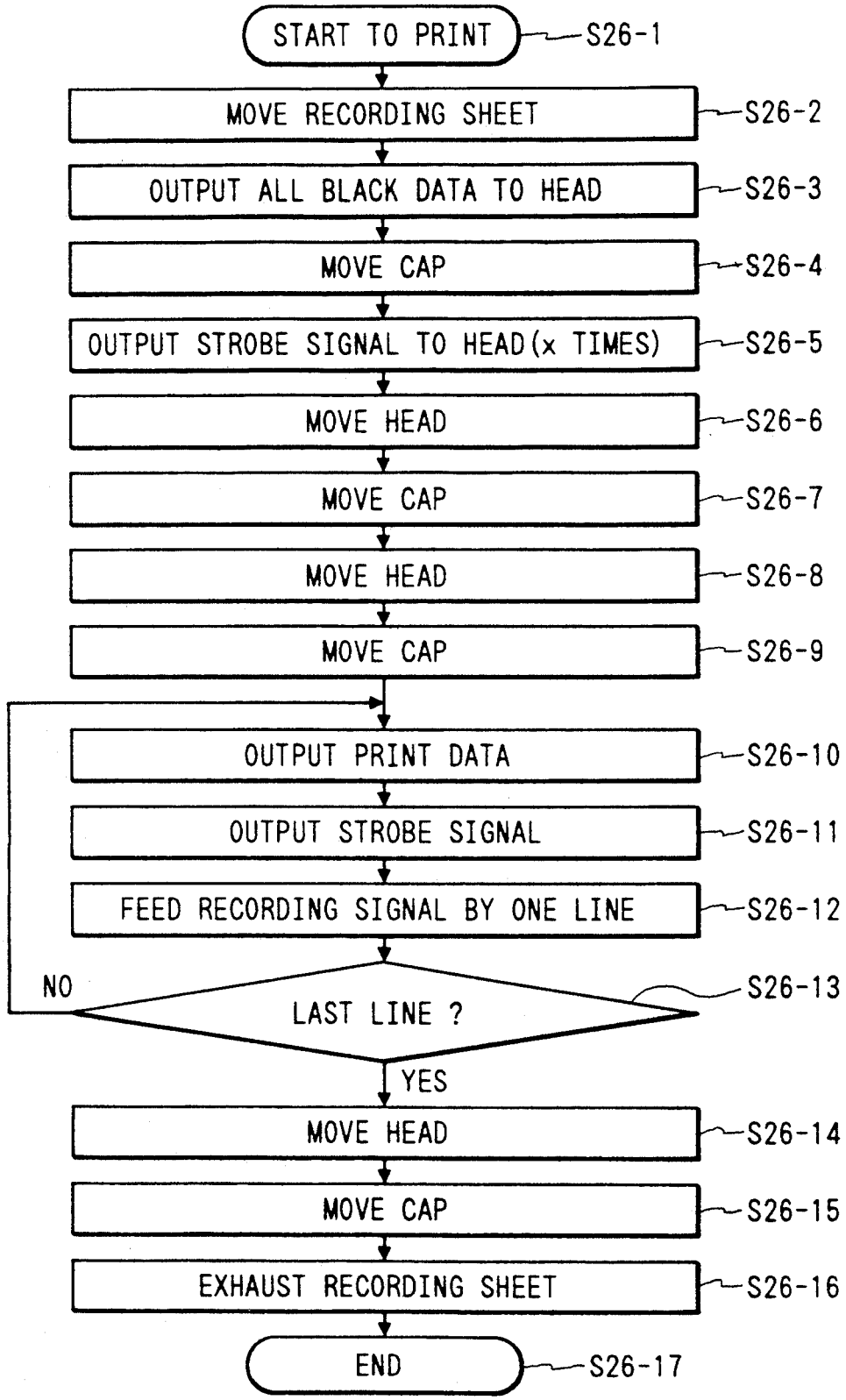
FIG. 26 is a flowchart showing an operation at the time of recording according to an embodiment of the present invention.

Next, in accordance with a flowchart shown in FIG. 26, the operation at the time of recording will be described.

At first, when the recording operation is started, W motor is driven for a required number of steps to convey a recording sheet to a predetermined position (S26-2).

Next, to head 38, black data for a one-line portion is transmitted (S26-3).

Then, a cap is retracted to the retracted position (S26-4). In this respect, C motor is driven for a predetermined number of steps, or is continuously driven until the moment sensor 110 detects that cap 41 has moved to the retracted position. Either method is applicable (hereinafter the movement of head and cap are the same).

Next, the so-called empty discharging is performed by transmitting a predetermined number of strobe signals (S26-5) to head 38.

Then, while the wiping action is being taken, head 38 is transported to the recording position. In other words, head 38 and wiper (cap unit 64) are transported to the starting position for wiping (S26-6 and S26-7), and by advancing head 38 to the recording position as it is, wiping is terminated (S26-8).

Also, after that, cap 41 is returned to the retracted position (S26-9).

The recording operation is executed by repeating the transmission of data each for a one-line portion to head 38, the transmission of strobe signals, the recording of the one-line portion (S26-10 and S26-11), and the driving of W motor to convey recording sheet for a one-line portion (S26-12) until the recording of a one-page portion is terminated.

Then, after the recording of the last line has been terminated (S26-13), head 38 is returned to the standby state (S26-14) and cap 41 is returned to the capping position (S26-15 and S26-16).

After that, W motor is driven to exhaust recording sheet (S26-17) to terminate the recording operation.

Figure 27:
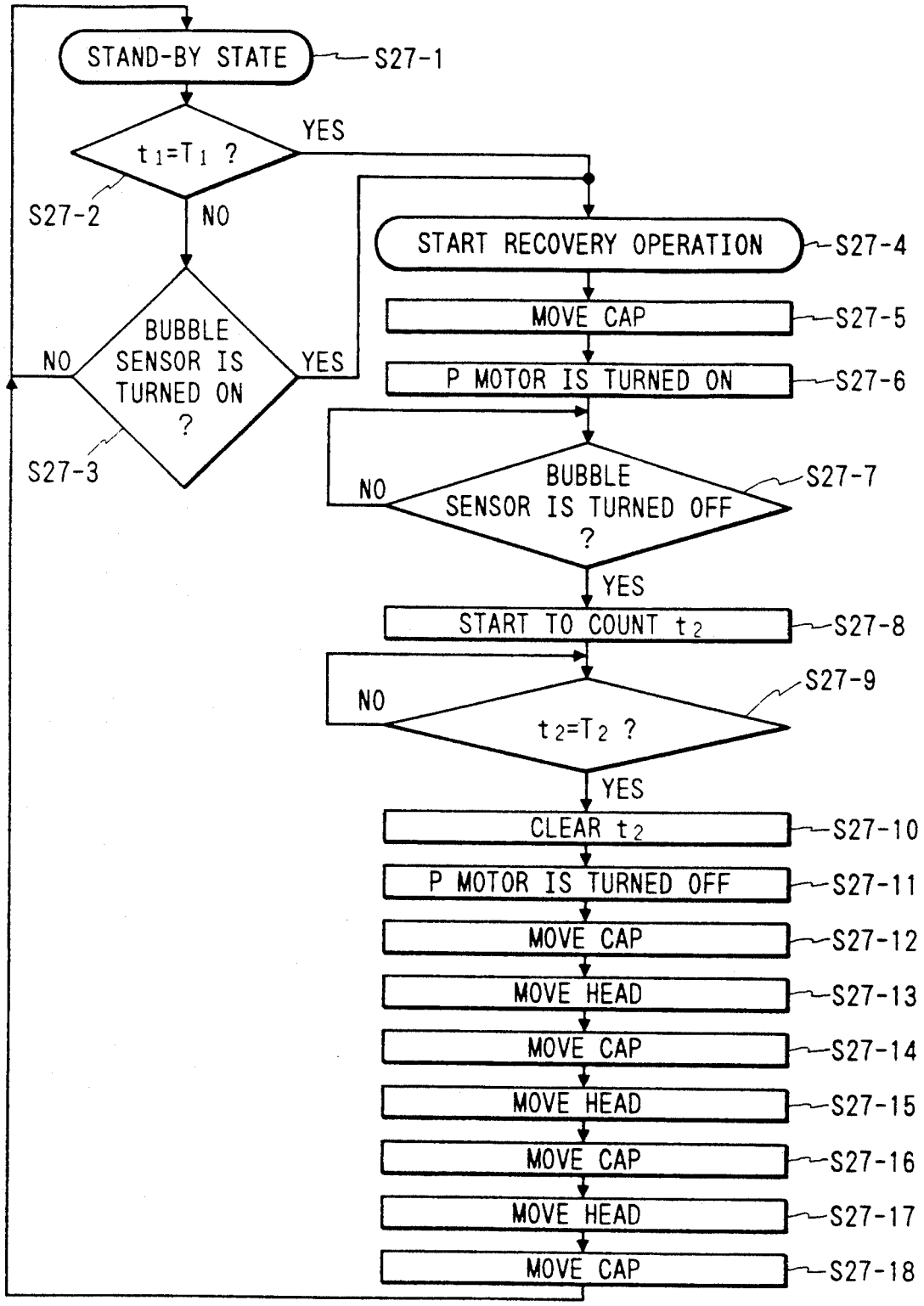
FIG. 27 is a flowchart showing a recovery operation according to an embodiment of the present invention.

Next, in accordance with FIG. 27, the recovery operation will be described.

While the apparatus is in the standby state, CPU examines timer $t_1$ in the CPU as well as the bubble sensor. If timer $t_1$ indicates a predetermined time $T_1$ (24 hours, for example), the recovery operation is started (S27-2).

Also, even when the timing is not $t_1=T_1$, the recovery operation is started if bubble sensor 111 is on (the presence of bubble indicated) (S27-3).

The recovery operation is performed as follows:

At first, C motor is driven to transport cap 41 to the pressing position (S27-5).

Next, P motor on signal is output to rotate P motor (S27-6).

Then, the output of bubble sensor 111 is detected, and when the sensor output is turned off, counter $t_2$ in the CPU starts counting (S27-7 and S28-8). When counter $t_2$ indicates a predetermined value $T_2$ (S27-9), time $t_2$ is cleared (S27-10), and turn off P motor (S27-11).

Then, the wiping action is actuated.

At first, cap is transported to the retracted position (S27-12). Subsequently, after transporting head 38 to the starting position for wiping, cap 41 is transported to the wiping position (S27-13 and S27-14), and then wiping is performed (S27-15) by transporting head 38 to the position for terminating wiping (printing position). Cap 41 is again returned to the retracted position (S27-16) and to the capping position after head 38 has been returned to the standby position (S27-17). Then, the apparatus is again in the standby state.

This terminates the recovery operation.

The present invention provides means for generating heat energy (for example, an electrothermal converter, a laser light, etc.) for the utilization of energy an ink discharging especially for ink jet recording method, and in a recording head and recording apparatus using a method to activate changes in a state of ink by utilizing the aforesaid heat energy, the present invention is particularly effective.

For the typical structure and principle of an invention of this kind, it is preferable to employ the fundamental principles disclosed in the specifications of, for example, U.S. Pat. Nos. 4,723,129 and 4,740,796. This method disclosed is applicable to the so-called on-demand type as well as to the continuous type. Particularly in the case of the on-demand type, by applying at least one driving signal, corresponding to recording information and providing a rapid temperature rise which exceeds nuclear boiling, to an electrothermal converter arranged for sheet or liquid passage holding liquid (ink), heat energy is generated in the electrothermal converter, and film boiling is accordingly generated on the thermal active face of the recording head. As a result, bubbles are formed in the liquid (ink) one to one by this driving signal effectively. By the growth and contraction of this bubble, the liquid (ink) is discharged through the discharging port to form at least one droplet. If this driving signal is made to be a pulse type, the growth and contraction of a bubble can be effectuated instantaneously and appropriately, and it should be more preferable to employ such system because with it, a discharging of liquid (ink) having an excellent responsibility can be attained. For a driving signal of the pulse type, those disclosed in the specifications of, for example, U.S. Pat. Nos. 4,463,359 and 4,345,262 should be suitable. In this respect, if conditions disclosed in the specification of U.S. Pat. No. 4,313,124 concerning an invention of the ratio of temperature rise on the aforesaid thermal active face are employed, a further excellent recording can be performed.

For the structure of the recording head, those structures, in which a thermal active unit is arranged in a bending region, disclosed in the specifications of U.S. Pat. Nos. 4,558,333 and 4,459,600 are included in the present invention in addition to a combination structure (linear liquid flow passage or right angled liquid flow passage) of discharging ports, liquid passage, and an electrothermal converter such as disclosed in each of the above mentioned specifications. Besides, the present invention is still effective for the structures based on the structure disclosed in Japanese Laid-Open Patent Application No. 59-123670 in which common slits against a plurality of electrothermal converters function as discharging ports of the electrothermal converter, and the structure disclosed in Japanese Laid-Open Patent Application No. 59-138461 in which an opening for absorbing the pressure wave of heat energy is used for the discharging port.

Particularly, the present invention is effectively applicable to the recording head of a full line type with a length to cover the width of a maximum recording medium which can be recorded by the recording head. For a recording head such as this, a structure in which a plurality of recording heads as disclosed in the above-mentioned specifications are combined to meet the requirements of such length or a structure in which one recording head, integrally formed, is adopted may be applicable, but the present invention displays the above-mentioned effects more efficiently.

In addition, the present invention is effectively applicable to the installation in the main body of an apparatus either in the case of a recording head of a chip type which is freely replaceable to enable the electrical connection with the main body of the apparatus or the ink supply from the main body of the apparatus or in the case of a cartridge type recording head which is integrally mounted in the recording head itself.

It is also desirable to add the recovery means for the recording head, preparative auxiliary means, etc. which constitute a recording apparatus according to the present invention because such addition makes the effects of the present invention more stable. These means are specifically capping means for the recording head, wiping means, pressuring or absorbing means, electrothermal converter, or another heating element or preparative heating means by the combination of these elements, and aside from discharging for regular recording, it is also effective to effectuate a preparatory discharging mode for performing a stable recording.

Furthermore, the present invention is extremely effective for a recording apparatus having at least one mode for recoloring with different colors or for full color with mixture of colors by the use of recording heads which are integrally structured into one head or by the combination of plural heads, not to mention the recording mode of principal color such as black, etc. as recording mode for a recording apparatus.

In the embodiment set forth above according to the present invention, the description has been made of the case where liquid ink is used, but the present invention is also applicable to solid ink at room temperature as well as to ink becoming soft at room temperature. In the above-mentioned ink jet apparatus, it is usual to perform temperature control to make viscosity of ink to be in the range of stable discharging by adjusting the temperature of ink itself to be more than 30° C. but less than 70° C. Therefore, if only ink becomes fluid at the time of applying recording signals in use, those kinds of ink are also usable. Furthermore, the present invention is applicable to the use of ink having the property that the ink becomes fluid only by heat energy such as the one which can be discharged as liquid ink when it becomes fluid by the application of heat energy in response to recording signals or ink already becoming solidified at the time of reaching the recording medium by utilizing positively the temperature rise caused by heat energy as energy to change the state of ink from solid to fluid for prevention or by using ink which is solidified when it is left for the purpose of preventing evaporation. In such case, ink can be held as liquid or solid state in a concave of porous sheet or through holes as described in Japanese Laid-Open Patent Application No. 54-56847 or Japanese Laid-Open Patent Application No. 60-71260, and is placed against the electrothermal converter in such mode. In the present invention, the performance of the above-mentioned film boiling method is most effective when each of the above-mentioned kinds of ink is employed.

Furthermore, the mode of an ink jet recording apparatus according to the present invention is such that in addition to the facsimile apparatus having receiving and transmitting functions as in the present embodiment, it can be used as image output terminal for information processing apparatus such as computer, etc, copying apparatus combined with reader, etc. or the like.

In the present embodiment, a recording head is used for the recovery operation by circulation with ink supply tubes arranged at both ends respectively, but the present invention is also applicable to a recording head of such type that it has only one ink supply tube and performs recovery operation by suction from the front face of the nozzle as a matter of course. It is also possible to reduce manufacturing costs by forming the bubble sensor integrally with the constituents of the head.

As set forth above, according to the present invention, it is possible to perform an accurate mating of the ink jet recording head and capping means without the precision of each individual part and precise adjustment at the time of assembly.

Furthermore, according to the present invention, it is possible to remove ink adhered to the orifice face by a plurality of cleaning members, so that ink can be removed completely. It is further possible according to the present invention to remove effectively ink strongly adhered to the orifice face by the plural cleaning members each having different contacting area, contacting angle, and contacting position provided by different sizes of the cleaning members.

As described above, the above embodiment is an ink jet recording apparatus comprising an ink jet recording head which discharges ink to record on a recording medium, capping means which covers the discharge ports of said ink jet recording head provided below the recording position by said ink jet recording head, and an ink tank which stores ink to be fed into said ink jet recording head.

According to this embodiment, since a portion, in which there is ink, is at the bottom, a possibility of ink leakage due to inclination of the apparatus is reduced. Also since the portion, in which there is ink, and a portion, in which ink does not exist, are divided, it is easy to divide the apparatus into units, and the following various effects are obtained: facilitating the design, simplifying the structure, improving the assembly ability, facilitating the maintenance, and securing and stabilizing the function. Further since a sufficient water head difference could be taken between the ink tank and recording head, the rate of change in pressure, which is attributed to the supply of ink, is reduced to enable good recording.

Further, the above-mentioned embodiment has been performed because preferred results were obtained by locating the conveyance route for the recording sheet above in the vertical direction with reference to the placement position of the recording head after strenous studies by the present inventors.

The above embodiment performed on the basis of this knowledge comprises an ink jet recording head which discharges ink to record on a recording medium, a conveyance route which leads the recording medium, which has been recorded by said ink jet recording head, in the exhaust direction passing above said recording head, and capping means which covers the discharge ports of said recording head provided below said ink jet recording head.

Especially an ink jet recording apparatus according to the above-mentioned embodiment has a chassis configuration, which is mainly divided into two: main body side and cover side. The main body side has means for driving the conveyance means for said recording head and said recording sheet, a space for housing a roll-shaped recording sheet, other main electrical circuits and a power supply unit. The cover side is capable of opening and closing against the said main body side. On cover side, a roller group on one side of a pair of conveyance roller groups in contact with each other is supported, the recording head is provided on the main body side below said roller group, and a conveyance route for recording sheets is so taken that the inside of rolling of said recording sheet is used as the recording surface. These structures simplify the conveyance route for the recording sheet and facilitate setting a recording sheet.

Such a configuration prevents ink droplets adhered to the recording head discharge port surface from dripping and adhering to the recording sheet.

Also even if the recording sheet is jammed, the recording head is not damaged because the capping operation enters immediately the moment jamming occurs to completely protect the recording head.

Although the present invention has been described referring to the embodiments as shown in FIG. 1 and others, the conception of the present invention is not limited to the detailed configurations within function units of the ink jet recording apparatus such as the recording head, recovery system and supply system. Even if, for example, the direction of the discharge aperture of the recording head during recording is constructed upward, the conception of the present invention is realized. Further, even if the number and shape of a pair of conveyance roller groups and driving means may be different, the conception of the present invention is, of course, not affected.

As described in detail, the present invention can provide an ink jet recording apparatus capable of high quality recording.

We claim:

1. An ink jet recording apparatus which records on a recording medium by discharging ink on a recording medium, comprising:

ink discharge means having an ink discharge port for discharging ink to record on the recording medium;

conveyance means for conveying the recording medium along a conveyance route a cap member for covering the discharge port to maintain an ink discharge state of said ink discharge means; and an ink storing member for storing ink discharged from the ink discharge port, wherein said ink discharge means, said cap member and said ink storing member are disposed vertically in that order from top to bottom, and the conveyance route of the recording medium is provided above said ink discharge means.

2. An ink jet recording apparatus according to claim 1, wherein said ink discharge means is capable of engaging with said cap member by rotating downwardly.

3. An ink jet recording apparatus according to claim 1, wherein said ink discharge means is of a full-line type, in which a plurality of discharge ports are formed over an entire width of a recording area of the recording medium.

4. An ink jet recording apparatus according to claim 1, wherein said ink discharge means discharges in by utilizing heat energy, and is equipped with an electrothermal converter to generate said heat energy.

5. An ink jet recording apparatus according to claim 1, wherein said ink discharge means is a facsimile apparatus equipped with a manuscript reader.

6. An ink jet recording apparatus which records on a recording medium by discharging ink on a recording medium, comprising:

ink discharge means having an ink discharge port for discharging ink to record on the recording medium;

an ink storing member for storing ink to be supplied to said ink discharge means;

a cap member for covering the ink discharge port to maintain an ink discharge state of said ink discharge means, said cap member being provided above said ink storing member;

a support section for supporting said ink discharge means in a position at which a discharge recovery operation is performed with said cap member, said support section being provided above said cap member; and conveyance means for conveying the recording medium along a conveyance route, wherein the conveyance route is provided above said ink discharge means.

7. An ink jet recording apparatus according to claim 6, wherein said ink discharge means is capable of engaging with said cap member by rotating downwardly.

8. An ink jet recording apparatus according to claim 6, wherein said ink discharge means is of a full-line type, in which a plurality of discharge ports are formed over an entire width of a recording area of the recording medium.

9. An ink jet recording apparatus according to claim 6, wherein said ink discharge means discharges ink by utilizing heat energy, and is equipped with an electrothermal converter to generate said heat energy.

10. An ink jet recording apparatus according to claim 6, wherein said ink discharge means is a facsimile apparatus equipped with a manuscript reader.

* * * * *

UNITED STATES PATENT AND TRADEMARK OFFICE

CERTIFICATE OF CORRECTION

PATENT NO. : 5,166,707

DATED : November 24, 1992

INVENTOR(S) : FUMIHIKO WATANABE, ET AL.

It is certified that error appears in the above-identified patent and that said Letters Patent is hereby corrected as shown below:

COLUMN 3

Line 58, "received" should read --receives--.

COLUMN 6

Line 3, "and" should read --end--.
Line 59, "clockwide" should read --clockwise--.

COLUMN 7

Line 29, "uide" should read --guide--.
Line 56, "38" should read --38a--.

COLUMN 8

Line 64, "rage" should read --range--.

COLUMN 9

Line 58, "arrow 8" should read --arrow ß--.

COLUMN 10

Line 45, "59b" should read --$59b_1$--.
Line 49, "(view)" should be deleted.
Line 56, "line o" should read --line α--.
Line 62, "curbed" should read --curved--.

COLUMN 11

Line 41, "event." should read --events.--.
Line 55, "deformed" hould read --deformed.--.

UNITED STATES PATENT AND TRADEMARK OFFICE

CERTIFICATE OF CORRECTION

PATENT NO. : 5,166,707

DATED : November 24, 1992

INVENTOR(S) : FUMIHIKO WATANABE, ET AL.

It is certified that error appears in the above-identified patent and that said Letters Patent is hereby corrected as shown below:

COLUMN 12

Line 3, "curbed" should read --curved--.
Line 24, "not," should read --not--.
Line 29, "curbed" should read --curved--.
Line 56, "wast" should read --waste--.

COLUMN 14

Line 11, "$50a_1$" should read --$59a_1$--.
Line 24, "pheripheral" should read --peripheral--.
Line 32, "close to" should read --to close--.

COLUMN 15

Line 21, "camprises" should read --comprises--.
Line 23, "breezer." should read --a breather.--.
Line 45, "Breezer" should read --Breather--.
Line 46, "breezer" should read --breather--.
Line 57, "breezer" should read --breather--.

COLUMN 16

Line 1, "bender" should read --disrupt--.
Line 37, "79a" should read --86--.
Line 41, "75b" should read --95b--.
Line 56, "inbetween," should read --in between,--.
Line 64, "indespensable" should read --indispensable--.

COLUMN 17

Line 2, "gloove 75a" should read --groove 75a--.

--

UNITED STATES PATENT AND TRADEMARK OFFICE

CERTIFICATE OF CORRECTION

PATENT NO. : 5,166,707

DATED : November 24, 1992

INVENTOR(S) : FUMIHIKO WATANABE, ET AL.

It is certified that error appears in the above-identified patent and that said Letters Patent is hereby corrected as shown below:

COLUMN 20

Line 52, "action" should read --actions--.

COLUMN 21

Line 39, "a" should be deleted.

COLUMN 22

Line 1, "moment" should read --movement--.
Line 63, "an" should read --for--.
Line 64, "for" should read --an--.

COLUMN 23

Line 23, "responsibility" should read --responsiveness--.

COLUMN 24

Line 30, "only ink" should read --ink only--.

UNITED STATES PATENT AND TRADEMARK OFFICE

CERTIFICATE OF CORRECTION

PATENT NO. : 5,166,707

DATED : November 24, 1992

INVENTOR(S) : FUMIHIKO WATANABE, ET AL.

It is certified that error appears in the above-identified patent and that said Letters Patent is hereby corrected as shown below:

COLUMN 26

Line 34, "route" should read --route;--.
Line 54, "in" should read --ink--.

Signed and Sealed this

Twenty-eighth Day of December, 1993

*Attest:*

*Attesting Officer*

BRUCE LEHMAN

*Commissioner of Patents and Trademarks*